US010405653B2

(12) United States Patent
Goetz et al.

(10) Patent No.: US 10,405,653 B2
(45) **Date of Patent: *Sep. 10, 2019**

(54) DRIVE DEVICES WITH SYNCHRONIZATION DEVICE FOR A MOVABLE FURNITURE PART

(71) Applicant: Julius Blum GmbH, Hoechst (AT)

(72) Inventors: Christof Goetz, Lustenau (AT); Bernd Koenig, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 0 days.

This patent is subject to a terminal disclaimer.

(21) Appl. No.: 15/723,625

(22) Filed: Oct. 3, 2017

(65) Prior Publication Data

US 2018/0020833 A1 Jan. 25, 2018

Related U.S. Application Data

(63) Continuation of application No. PCT/AT2016/000024, filed on Mar. 8, 2016.

(30) Foreign Application Priority Data

Apr. 14, 2015 (AT) ..... 50292/2015

(51) Int. Cl.
*A47B 88/44* (2017.01)
*A47B 88/46* (2017.01)
(Continued)

(52) U.S. Cl.
CPC ..... *A47B 88/447* (2017.01); *A47B 88/463* (2017.01); *E05F 1/00* (2013.01); *E05F 7/00* (2013.01)

(58) Field of Classification Search
CPC ..... A47B 88/40; A47B 88/44; A47B 88/443; A47B 88/447; A47B 88/45; A47B 88/463;
(Continued)

(56) References Cited

U.S. PATENT DOCUMENTS 4,832,420 A 5/1989 Rock et al.
6,910,749 B2 6/2005 Mueller
(Continued)

FOREIGN PATENT DOCUMENTS

AT 8882 8/1902
AT 008 882 U1 2/2007
(Continued)

OTHER PUBLICATIONS

International Search Report dated Jun. 16, 2016 in International (PCT) Application No. PCT/AT2016/000024.
(Continued)

*Primary Examiner* — Andrew M Roersma
(74) *Attorney, Agent, or Firm* — Wenderoth, Lind & Ponack, L.L.P.

(57) ABSTRACT

An arrangement includes a first drive device for moving a movable furniture part, a second drive device for moving the same movable furniture part, and a synchronization device for synchronizing the two drive devices. The two drive devices can assume different positions during the movement of the movable furniture part. The arrangement also includes a correction device, by which both drive devices can be brought into the same position.

18 Claims, 47 Drawing Sheets

(51) Int. Cl.

| | |
|---|---|
| ***E05F 1/00*** | (2006.01) |
| ***E05F 7/00*** | (2006.01) |
| ***A47B 88/447*** | (2017.01) |
| ***A47B 88/463*** | (2017.01) |

(58) Field of Classification Search

CPC . A47B 88/0477; A47B 88/47; A47B 88/0481; A47B 2210/0064; A47B 2210/0067; A47B 2210/007; A47B 2210/0072; A47B 2210/0075; A47B 2210/0078; A47B 2210/0081; A47B 2210/0083

See application file for complete search history.

(56) References Cited

U.S. PATENT DOCUMENTS

| | | | |
|---|---|---|---|
| 8,016,374 | B2 | 9/2011 | Kropf et al. |
| 8,474,925 | B2 | 7/2013 | Koenig et al. |
| 8,534,781 | B2 | 9/2013 | Netzer et al. |
| 9,039,109 | B2 | 5/2015 | Salice |
| 9,109,649 | B2 | 8/2015 | Bohle |
| 2003/0117048 | A1 | 6/2003 | Mueller |
| 2007/0103041 | A1 | 5/2007 | Kropf et al. |
| 2007/0103043 | A1 | 5/2007 | Kropf et al. |
| 2010/0320888 | A1 | 12/2010 | Koenig et al. |
| 2010/0327719 | A1 | 12/2010 | Koenig et al. |
| 2012/0038255 | A1 | 2/2012 | Netzer et al. |
| 2013/0328468 | A1 | 12/2013 | Schneider et al. |
| 2013/0334946 | A1 | 12/2013 | Netzer et al. |
| 2014/0009054 | A1 | 1/2014 | Salice |
| 2014/0060991 | A1 | 3/2014 | Bohle |
| 2014/0210329 | A1 | 7/2014 | Brunnmayr |
| 2016/0206093 | A1 | 7/2016 | Brunnmayr et al. |
| 2017/0020285 | A1 | 1/2017 | Schallert et al. |
| 2017/0095084 | A1* | 4/2017 | Koenig ..... E05F 1/16 |

FOREIGN PATENT DOCUMENTS

| | | |
|---|---|---|
| AT | 514865 | 4/2015 |
| CN | 101716032 | 6/2010 |
| CN | 101951808 | 1/2011 |
| CN | 103479106 | 1/2014 |
| CN | 103584527 | 2/2014 |
| CN | 203662294 | 6/2014 |
| CN | 204120563 | 1/2015 |
| DE | 20 2009 005 255 | 4/2011 |
| DE | 20 2012 003 004 | 8/2013 |
| EP | 1 314 842 | 5/2003 |
| EP | 2 429 339 | 3/2012 |
| TW | 201302128 | 1/2013 |
| TW | M479665 | 6/2014 |
| WO | 2009/114884 | 9/2009 |
| WO | 2009/114885 | 9/2009 |
| WO | 2012/159136 | 11/2012 |
| WO | 2013/059847 | 5/2013 |
| WO | 2015/154107 | 10/2015 |

OTHER PUBLICATIONS

Search Report dated Dec. 22, 2015 in Austrian Application No. A 50292/2015, with English translation.

* cited by examiner

VS

SS

VS

SS

ÜS

OS

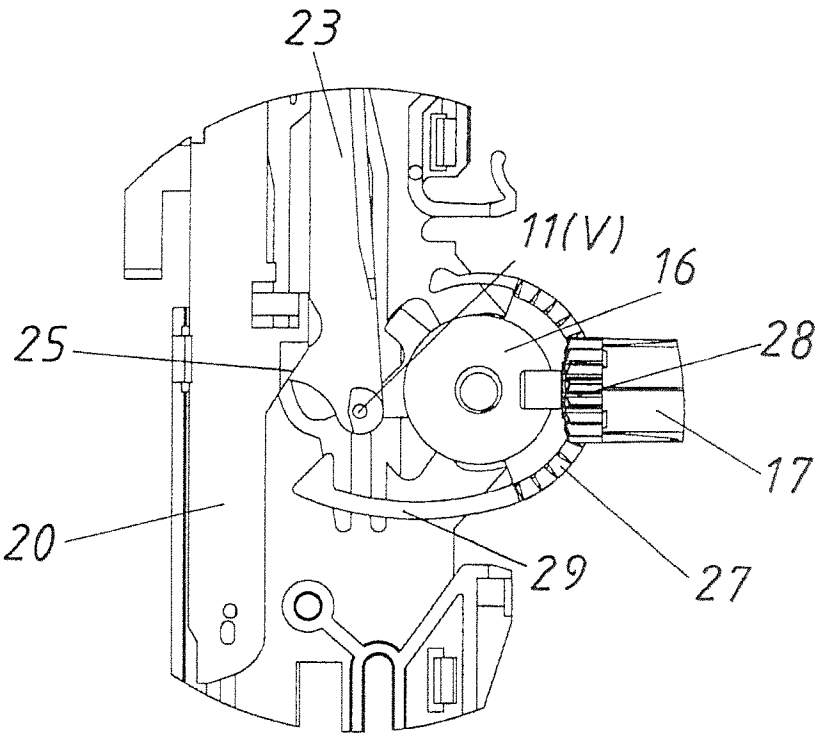
Fig. 20A
SS
VS
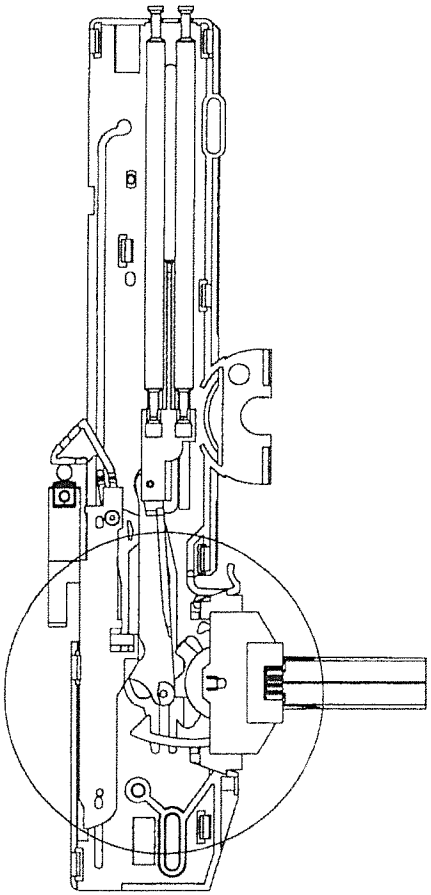

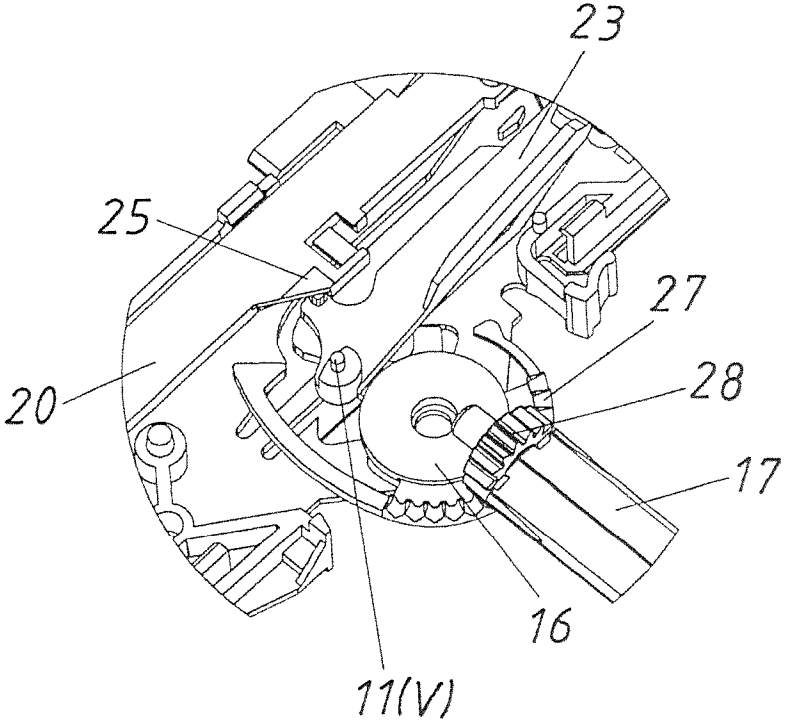
Fig. 20B
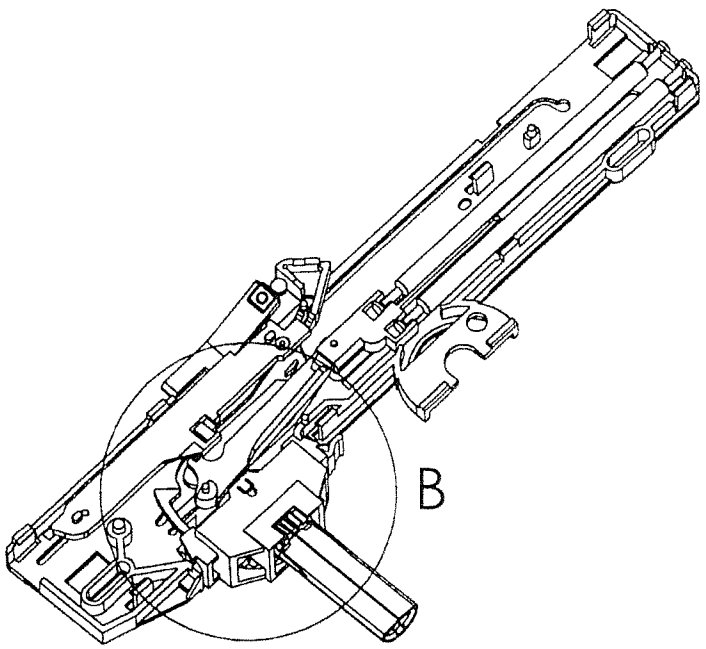

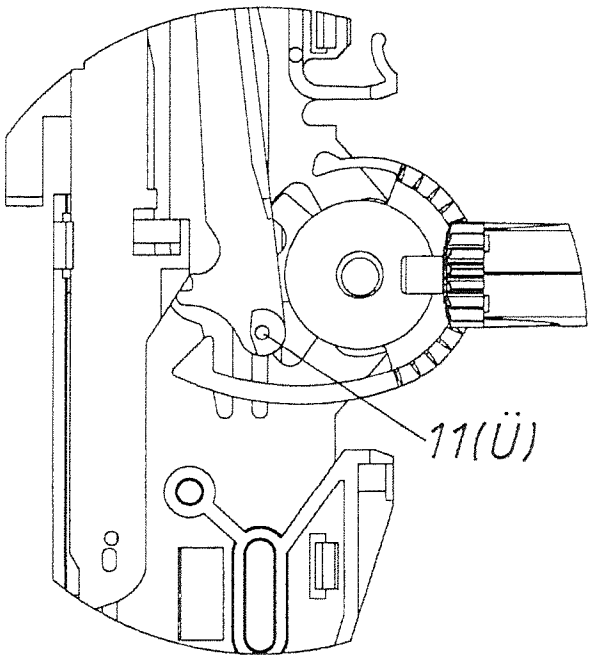
Fig. 21A
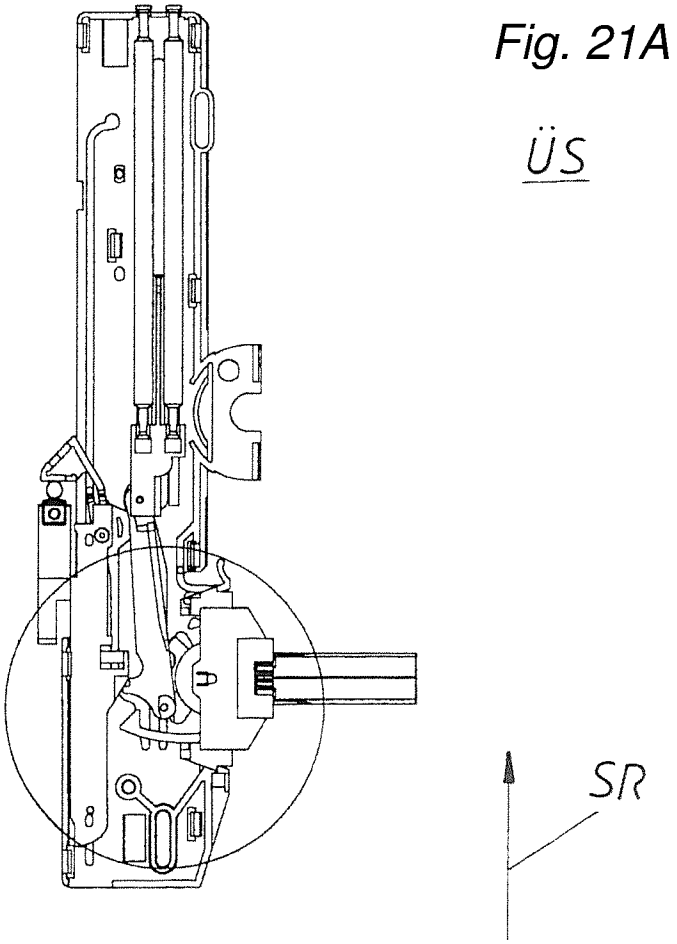

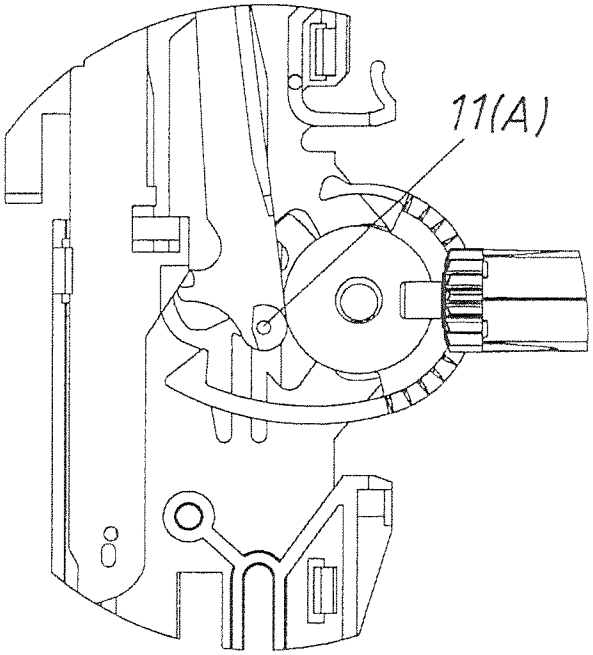
Fig. 22A
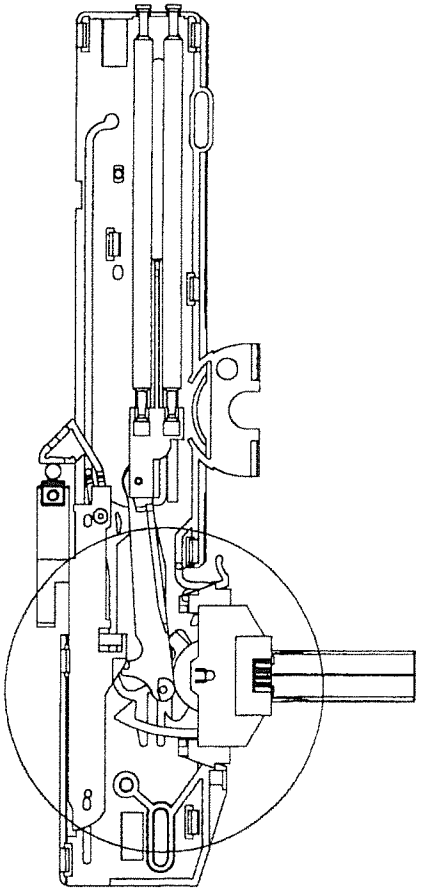

SCHNITT i-i

SCHNITT ii-ii

SCHNITT iii-iii

DRIVE DEVICES WITH SYNCHRONIZATION DEVICE FOR A MOVABLE FURNITURE PART

BACKGROUND OF THE INVENTION

The invention concerns an arrangement comprising a first drive device for moving a moveable furniture part, a second drive device for moving the same moveable furniture part and a synchronizing device for synchronizing the two drive devices, and the two drive devices can assume different positions during the movement of the moveable furniture part. Moreover, the invention concerns an item of furniture with such an arrangement.

Drive devices—so-called touch latch mechanisms—for moving or ejecting moveable furniture parts (drawers, furniture doors, flaps, etc.) have been known in the industrial sector of furniture fittings for many years. Thereby, the opening movement is carried out automatically and a user only has to press onto the moveable furniture part in order to activate the ejection mechanism.

Especially in the case of broad drawers, often two drive devices are provided on opposing side areas of the drawer or of the furniture carcass in order to securely detect a pressing onto the drawer on any position. If now, however, by this pressing onto the drawer only one of the two drive devices is triggered, it can lead to problems like a slanted position of the drawer or that the drawer get stuck or is wedged.

In order to solve these problems, several methods with synchronizing devices for synchronizing the two drive devices are known from the state of the art. Thereby, movements of the drive devices distanced from each other are brought into line, with other words precisely synchronized. This shall guarantee a both-sided equal motion sequence.

Examples for such drive or ejecting devices with synchronization are disclosed in the EP 2 429 339 B1, the WO 2009/114884 A1, the EP 1 314 842 B1 and the AT 008 882 U1. In the case of these devices the whole unlocking process and also parts of the ejection process are synchronized.

Another example of a synchronization is shown in WO 2013/059847 A1, according to which it is particularly emphasized that the locking—and not the unlocking—of both sides takes place synchronously in order to guarantee a secure and unimpeded closing.

Moreover, DE 20 2009 005 255 U1—in contrast to the previously quoted documents—does not comprise a separate structural component of the ejection device as a synchronization element. Rather, here the drawer quasi itself is a synchronization element as the force of a just unlocked latch fitting is transmitted by means of the drawer to the other latch fitting, whereby the force of both ejection force storage member effects the unlocking of the other latch fitting.

Further, WO 2012/159136 A1 teaches a synchronizing device for a moveably supported furniture part. There, a synchronizing rod comprises two semi-shafts, between which an overload device is arranged. When exceeding a predetermined holding torque a rotary movement between the two semi-shafts is enabled. Thereby, the synchronizing rod is brought from an operating position into an overload position. In this overload position no movement transmission or synchronization is possible. This is only possible when the latch part—which is unlatched in the case of an overload—is again correctly latched in one of the semi-shafts, wherein then the original relative position of the two semi-shafts to each other is again reached.

A generic arrangement is disclosed in the not pre-published Austrian Patent Application AT 514 865 (Application Number A 785 2013). As not all movements of the components (ejection slider, transmission elements, control lever, etc.) of the drive device are synchronized permanently, it can happen that the two drive devices of the arrangement are located in positions different from each other. This can have the effect that the two drive devices do not carry out their movements together (synchronously). Thus, no secure locking and no jointly ejecting are possible. The drawer, therefore, can no longer be operated as intended.

SUMMARY OF THE INVENTION

Therefore, the object of the present invention is to provide an arrangement which is improved compared to the state of the art. In particular, the operational reliability should be improved.

Hence, according to the invention, a correction device is provided, by which the two drive devices can be brought into the same position. In other words, it is guaranteed by the correction device that the two drive devices are situated in the same position during the motion sequence of the drive device or that the two drive devices return to the same position.

Different positions of the drive device are, for example, the position in a tensioning section, the position in a locking section, the position in an over-pressing section and/or the position in an ejecting section. As an example, one of the drive devices is situated in a position at the beginning of the tensioning section, whereas the other drive device—e. g. because of an operating error—is situated in a position at the end of the locking section. If now an active closing movement of the moveable furniture part is carried out, an erroneous triggering of the second-mentioned drive device would happen although the first-mentioned drive device has not yet arrived in a position at the end of the locking section. This is prevented by a correction device which brings the two drive devices into the same position—for example before the second-mentioned drive device is triggered.

In principle, the correction device can be formed in such a way that the correction device detects a false position with the aid of a respective electronic detecting device and that the correction device based on a respective signal triggers a correction movement of one of the drive devices. This can be carried out independent of the respective position of the moveable furniture part. This means the correction device automatically recognizes whether a false position is given within the arrangement and triggers a respective correction movement. Preferably, however, it is provided that during the movement of the moveable furniture part the two drive devices can be brought into the same position by the correction device. Particularly preferred the triggering of the correction device is carried out by the movement of the moveable furniture part.

Per se it is arbitrary in which same position the drive devices are brought by the correction device. Preferably, the drive devices can be brought in the locking position at the end of the locking section by the correction device.

In principle, the correction device can be part of the drive devices. For example, a position monitoring can be carried out by a position sensor. On the basis of a respective signal, the movement of one of the drive devices is then blocked until the other drive device reaches the same position. Preferably, however, a purely mechanical correction device is provided.

According to a particularly preferred embodiment, the correction device is part of the synchronizing device. A functionally simple embodiment provides that the synchronizing device comprises a synchronizing rod with a first rod member and a second rod member which is rotatable to the first rod member, wherein the two rod members also form parts of the correction device. By means of the rotatability of the rod member to each other, thus, the false position of the drive devices is corrected.

Especially, this can be carried out in that the two rod members have a first operating position to each other, in which a predetermined holding torque is given between the two rod members and that the two rod members have a second operating position to each other, which second operating position is rotated in comparison to the first operating position. Here, for a steady functionality, it is particularly preferred that in the second operating position the holding torque between the two rod members is substantially as large as the holding torque in the first operating position. Thus, also in the case of a later again occurring false position the correction device can again be operated in the same manner.

It is possible that the synchronizing device is in direct connection with a part (e. g. the ejection slider) of the respective drive device. In the case of a preferred embodiment, however, the synchronizing device comprises a first coupling element for connecting the synchronizing device with the first drive device and a second coupling element for connecting the synchronizing device with the second drive device, and the coupling elements are motion-transmitting connected by means of the synchronizing rod. There, this motion transmission is preferably carried out in that the coupling elements and the synchronizing rod each are connected by a gear rack formed on each coupling element and by a gear wheel being part of the synchronizing rod, wherein the gear rack and the gear wheel are meshing with each other.

In order to recognize the position of the drive device or of parts of the drive device, in a preferred mechanical embodiment, the coupling elements each can be moved to a limited extent by a, preferably yielding, limit-stop. In this situation, the limit-stop can be part of a housing. The coupling elements, in turn, are moveably—preferably rotatably—supported on this housing.

For the false position correction, according to a preferred embodiment, in the case of the first coupling element abutting the limit-stop and simultaneous movement of the second coupling element, the rod members of the synchronizing rod prevent a movement transmission from the second coupling elements to the first coupling element by way of a rotation of the rod members to teach other. Thus, the first coupling element cannot move and an undesired moving of the respective drive device into a further position is prevented. Especially, the rotation and, thus, the correction is triggered by the correction device in that a rotary movement between the first rod member and the second rod member is carried out when the force—in form of a holding torque—between the two rod members is smaller than the force which the limit-stop opposes to a movement of the respective couplings element. This takes effect especially then when the limit-stop is formed yieldingly, for example as a leaf spring or as an elastic arm. Therefore, it is particularly preferred that the two coupling elements, the limit-stops for the coupling elements and the rod members being rotatable to each other are forming the correction device.

In order to guarantee a steady as possible functionality of the correction device, preferably the first rod member can be inserted into the second rod member, and the holding torque between the rod members—independent of an inserting depth of the first rod member in the second rod member—remains substantially constant.

For the design of the drive devices, it shall be mentioned initially that these drive devices do not have to be formed identically constructed or functionally equivalent. For an easy mass production, however, preferably the drive devices are formed substantially mirror-symmetrical.

Concretely, preferably the drive devices each comprise a lockable ejection device for ejecting the moveable furniture part from a closed position into an open position and a locking device for locking the ejection device in a locking position. The ejection device can be unlocked from the locking position by an over-pressing movement of the moveable furniture part into an over-pressing position situated behind the closed position.

The preferred embodiments elucidated in the following are always meant for both drive devices, even though the specific description is always only based on the first drive device and its components. Thus, the full disclosure analogously applies also for the second drive device.

Concretely, in a preferred embodiment of the present invention, the first ejection device comprises a housing, an ejection slider displaceable on the housing, an ejection force storage member acting on the ejection slider and a control lever mounted moveably, preferably rotatably, to the ejection slider. The first locking device comprises a latching element being arranged on the control lever and a locking element against which the latching element bears in the locking position.

Further, preferably in the case of the over-pressing movement, the latching element is moveable from the locking position into the over-pressing section and in the case of the opening movement is moveable by the ejection force storage member through an ejection section. The locking element is moveable by the latching element which is moved from the ejection section into the opening direction. This means, when the latching element is no longer situated in the locking position, the latching element can move the locking element.

Basically, the locking can be carried out by touch latch mechanisms known per se. Preferably, however, the first drive device comprises a cardioidal sliding track for the latching element. The sliding track comprises a tensioning section provided in the housing for tensioning the ejection force storage member, a locking section, and the locking element also forms the locking section. The over-pressing section is provided in the housing, and the ejection section is provided in the housing.

Further, preferably the locking element is connected with the synchronizing device. A particularly simple arrangement with few construction parts emerges then when the locking element is formed in one piece with the synchronizing device or at least with one element of the synchronizing device. Here, it can also be provided that the locking element is mounted moveably, preferably rotatably, to the housing.

The particular advantages of a simple construction especially emerge when the locking element has a locking surface against which the latching element bears in the locking position, and a synchronizing surface against which the latching element bears in the movement through the ejection section in the opening direction. In that case the locking surface is oriented substantially tangentially relative to the direction of rotation of the locking element and the synchronizing surface is oriented substantially radially in relation to the axis of rotation of the locking element. This means, no rotation of the locking element—and thus no synchronization—can be triggered by exerting force on the locking surface. It is only by exerting force on the synchronizing surface that the rotary movement and thus the synchronizing movement can take place.

Preferably, the locking element is part of the coupling element. Particularly preferably, the locking element is in one piece with the coupling element of the synchronizing device.

Further, an item of furniture can include a furniture carcass, a furniture part mounted moveable to the furniture carcass, and an arrangement according to the invention.

BRIEF DESCRIPTION OF THE DRAWINGS

Further details and advantages of the present invention are described more fully hereinafter by the specific description made with reference to the examples illustrated in the drawings, in which:

FIGS. 20A to 23B are a plan view and a perspective view of the movements of the arrangement shown in FIG. 19, FIGS. 24 to 27 show the erroneous motion sequence of an arrangement without a correction device.

DETAILED DESCRIPTION OF THE DRAWINGS

An arrangement 1 is described in the FIGS. 1 to 23B which is disclosed in the not pre-published AT 514 865. Also a preferred embodiment of the present invention is structurally identical from the basic construction. Differences are particularly given in the section of the synchronizing device 6, which differences are elucidated in drawings starting from FIG. 24 following later.

Figure 1:
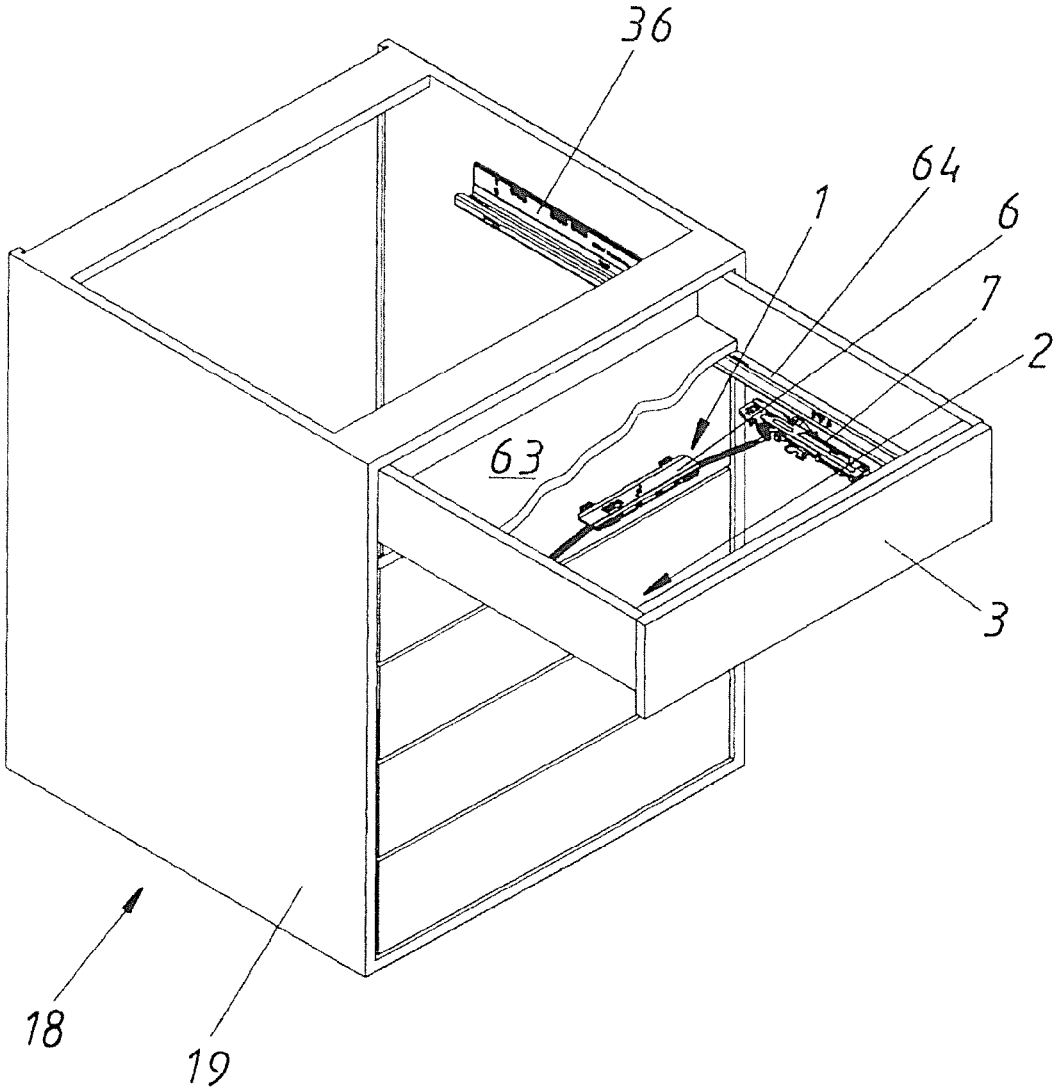
FIG. 1 shows an item of furniture with a moveable furniture part together with the drive devices and a synchronizing device in a partly in a partly broken-away perspective.

FIG. 1 shows an article of furniture 18 comprising a furniture carcass 19 and a furniture part 3 which is moveable relative thereto in the form of a drawer, as a partly broken-away perspective view. This drawer is mounted moveably to the furniture carcass 19 by way of an extension guide 36. Mounted at the underside of the moveable furniture part 3 is an arrangement 1 which has two drive devices 2 (see particularly FIG. 5) and 7 which are fixed laterally to the drawer bottom 63 and to a drawer rail 64 respectively, and a synchronizing device 6.

Figure 2:
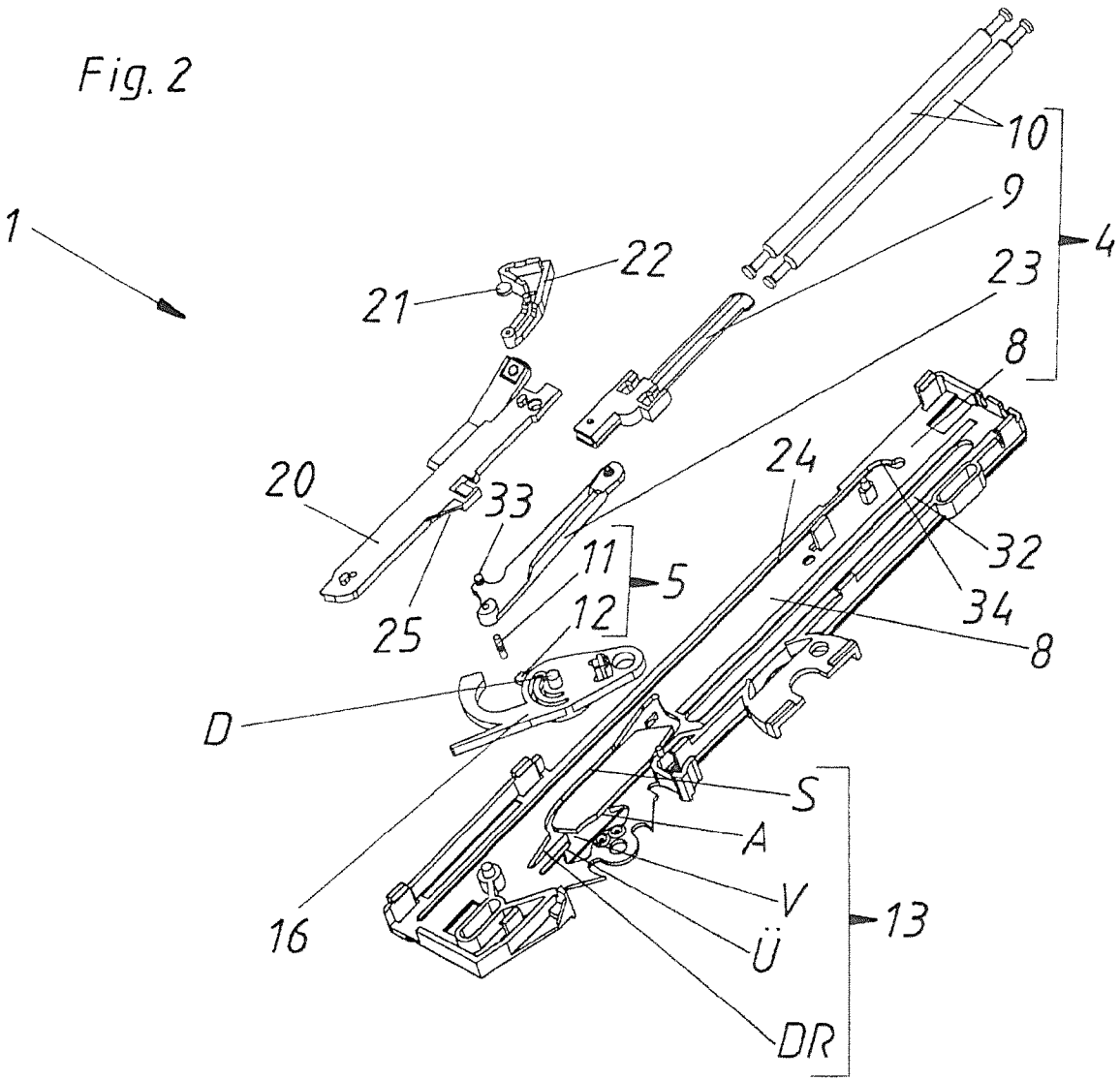
FIG. 2 is an exploded view of a drive device.

FIG. 2 shows an exploded view of the essential components of the arrangement 1 together with the first drive device 2. The first drive device 2 is mounted to the moveable furniture part 3 by way of the housing 8. The ejection force storage members 10 which are in the form of tension springs are held on the one hand to the housing 8 and on the other hand to the ejection slider 9. The ejection slider 9 is displaceable along the guide track 32 in the housing 8. The housing 8, the ejection force storage members 10, the ejection slider 9 and the control lever 23 together form the essential components of the first ejection device 4. In addition however the transmission element 20 can also be associated with the first ejection device. The transmission element 20 bears by way of the transmission abutment 25 against the abutment 33 on the control lever 23. The transmission element 20 is displaceable along the control track 24 in the housing 8. That control track 24 has an angled end section 34. As soon as the catch lever 22 hingedly connected to the transmission element 20 passes into that angled end section 34 the catch lever 22 pivots whereby the drive device 2 is released from the entrainment member 21 which is fixed with respect to the furniture carcass. When conversely the catch lever 22 leaves that angled end section 34 the entrainment member 21 is caught or held between the catch lever 22 and the transmission element 20. In addition, the coupling element 16 of the synchronizing device 6 is mounted rotatably about the axis of rotation D on the housing 8. Also provided in one piece with that coupling element 16 is the locking element 12 which jointly with the latching element 11 disposed on the control lever 23 forms the locking device 5 for the first ejection device 4. In addition, the Figure shows the cardioidal sliding track 13 which is provided in the housing 8 and which has the tensioning section S, the pressing-through section DR, the locking section V, the over-pressing section Ü and the ejection section A. The locking section V is additionally also formed by the locking element 12.

Figure 3:
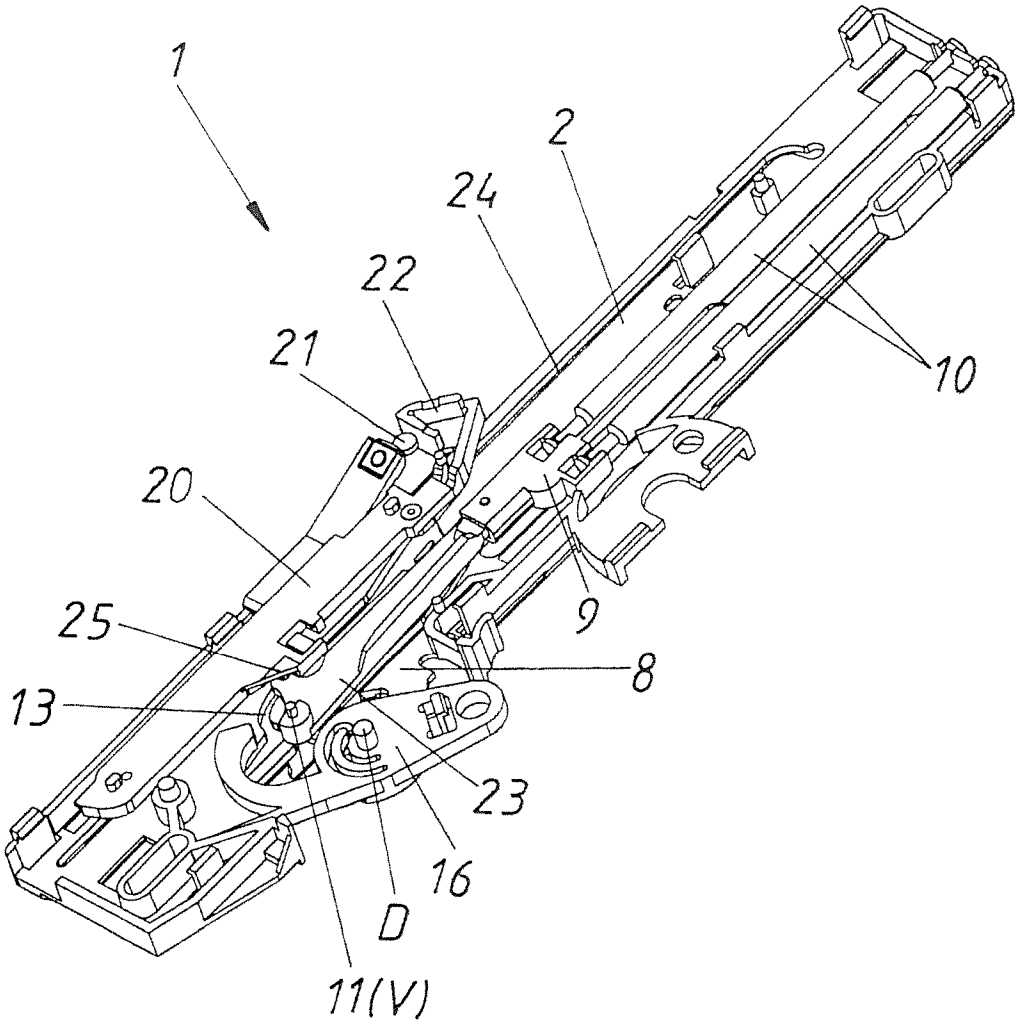
FIG. 3 is a perspective view of the assembled drive device.

FIG. 3 shows the arrangement 1 in the assembled condition. The ejection force storages members 10 are stressed and the latching element 11 is disposed in the locking section V whereby the first ejection device 4 is in the locking position VS. As the entrainment member 21 is caught by the catch lever 22, the moveable furniture part 3 is in the closed position SS.

Figure 4:
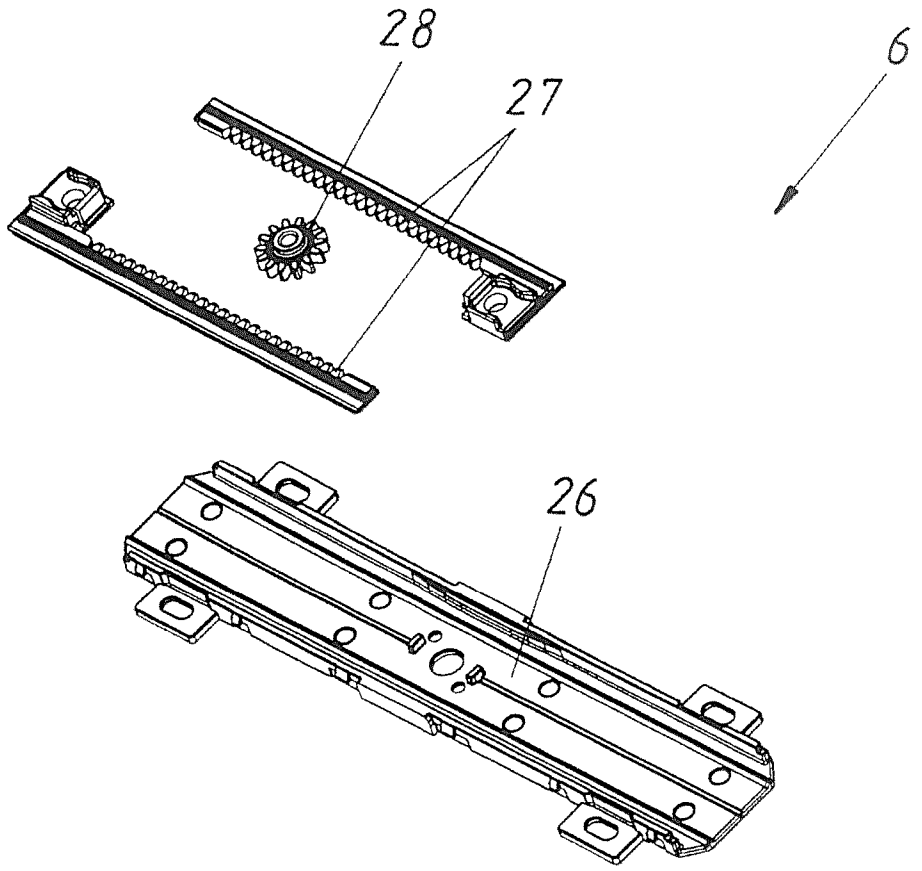
FIG. 4 shows parts of a synchronizing device.
Figure 5:
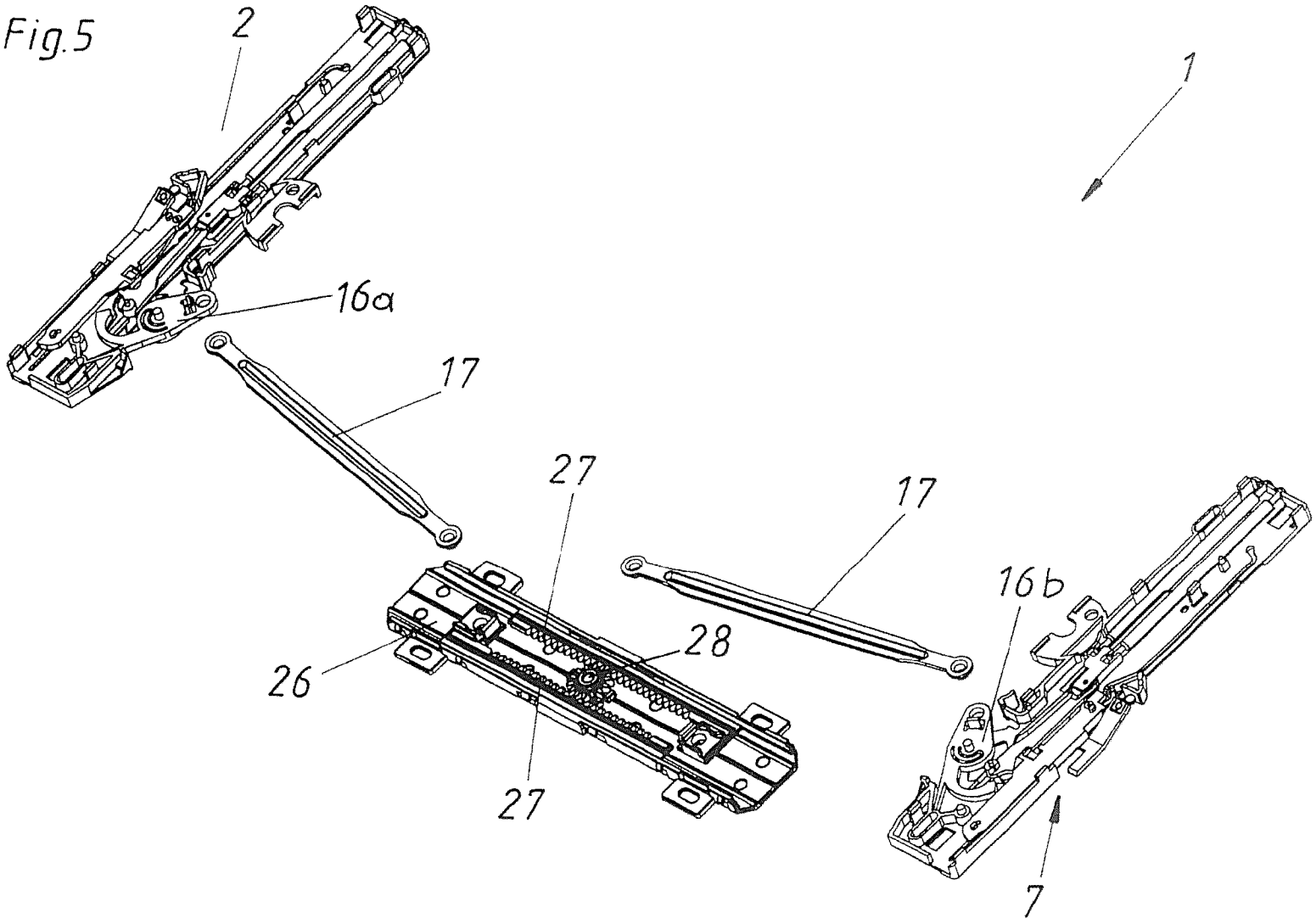
FIG. 5 is a partly exploded view of the arrangement with two drive devices and the synchronizing device.

An example of components of a synchronizing device 6—which is not constructed according to the invention—is shown in FIG. 4. In this case, the gear racks 27 and the gear wheel 28 are mounted moveably to the base plate 26. FIG. 5 shows the individual components of the arrangement 1 in a condition of not yet being entirely assembled as the connection by way of the synchronizing rods 17 has not yet been made. This, however, is shown in FIG. 6 whereby the synchronizing rods 17 are respectively rotationally hingedly connected on the one hand to the coupling elements 16 and on the other hand to the gear racks 27.

Figure 6:
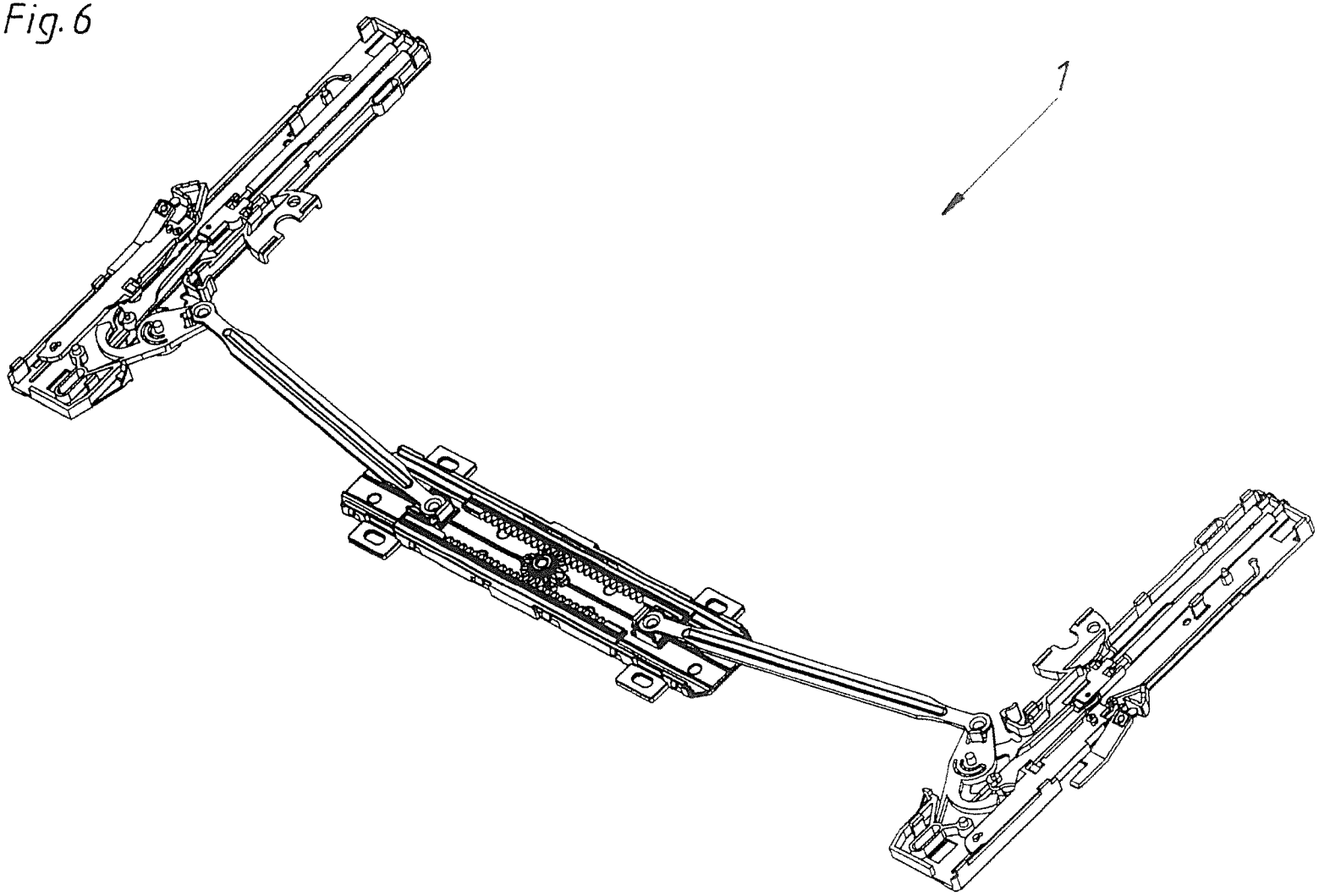
FIG. 6 shows the assembled arrangement.
Figure 7:
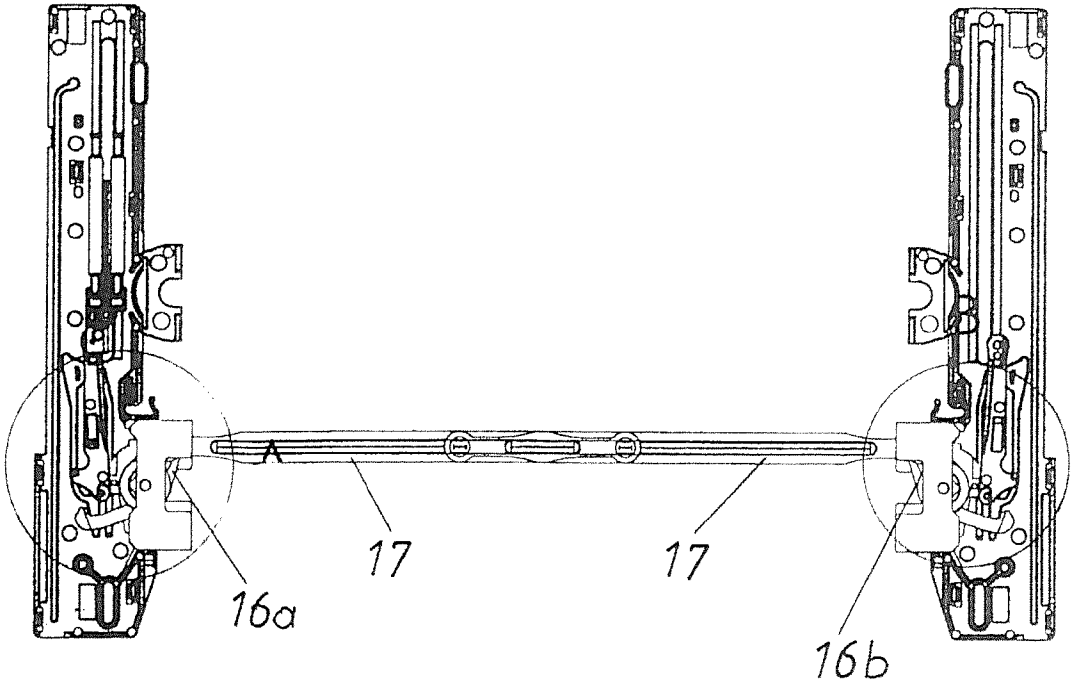
FIG. 7 shows an alternative variant of the synchronizing device.

FIG. 7 shows a configuration of the synchronizing device 6, which is an alternative to FIG. 6, wherein the synchronizing rods 17 are positively guided linearly against each other by way of slot connections.

For FIGS. 8 to 23B, the basic motion sequence of the drive devices 2 and 7 and the synchronizing device 6 is elucidated in the following. Although the shown components with the reference signs 17, 26, 27 and 28 are not constructed according to the invention, the described function sequence takes effect analogously also for a preferred embodiment of the arrangement 1 according to the invention.

Figure 8:
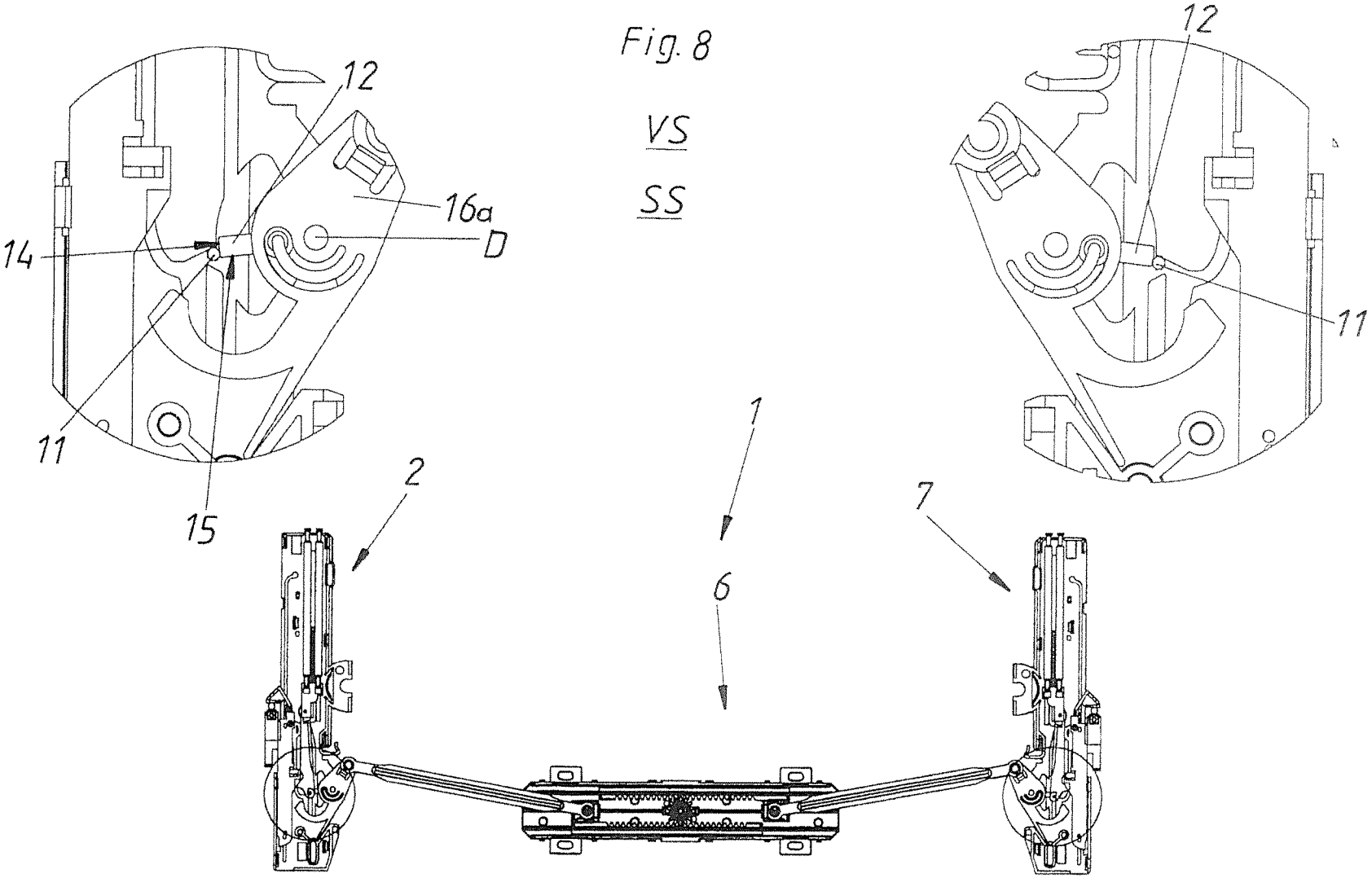
FIGS. 8 to 18 are plan views of the movements of an arrangement.

FIG. 8 shows a plan view of the arrangement 1 with the first drive device 2, the second drive device 7 and the synchronizing device 6. It is possible to see from the detail sections shown at left and right that in each case the latching element 11 is in the locking section V of the cardioidal sliding track 13. In this situation, the latching element 11 bears against the locking surface 14 of the locking element 12. That locking surface 14 is oriented tangentially relative to the direction of rotation of the axis of rotation D. As therefore the force of the ejection force storage members 10 that is acting on the latching element 11 cannot trigger a rotary movement of the coupling element 16, the ejection devices 4 respectively remain in their locking position VS. The moveable furniture part 3 is disposed in the closed position SS.

Figure 9:
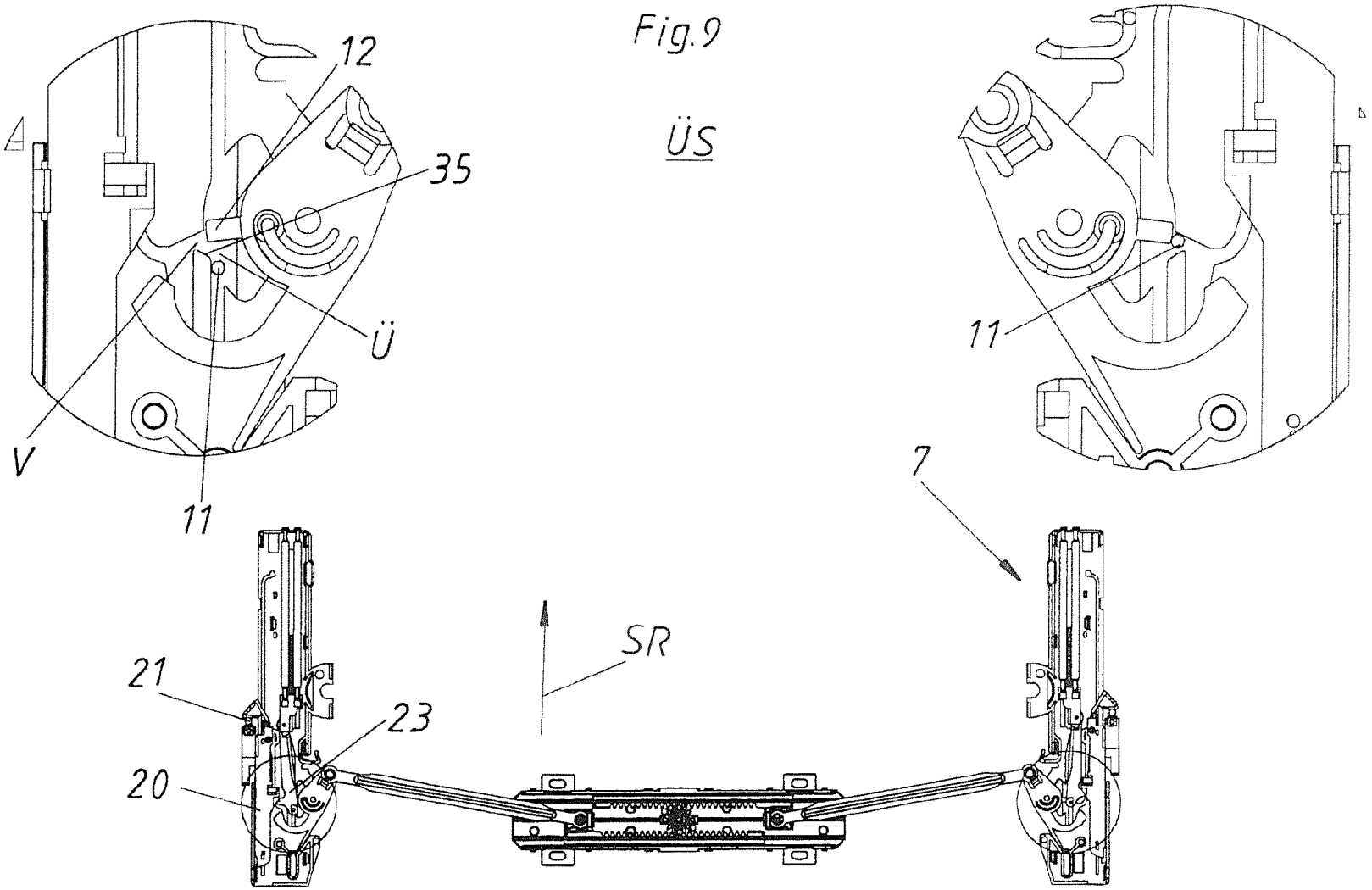

If now starting from FIG. 8 a pressure is applied at one side in the closing direction SR to the left-hand region of the moveable furniture part 3 the latching element 11 of the first drive device 2 is moved into the overpressing section Ü as the housing 8 moves in the closing direction relative to the control lever 23, the transmission element 20 and the entrainment member 21 (see FIG. 9). In that case, the latching element 11 is moved by the inclined deflection section 35 from the locking section V into the over-pressing section Ü. That over-pressing movement begins free from a movement transmission between the first drive device 2 and the synchronizing device 6. The second drive device 7 thus remains uninfluenced by that over-pressing movement on the left-hand side. As a result the over-pressing movement is only performed against the force of the ejection force storage member 10 of an ejection device 4. The moveable furniture part is thus disposed—at least at one side—in the over-pressing position ÜS.

Figure 10:
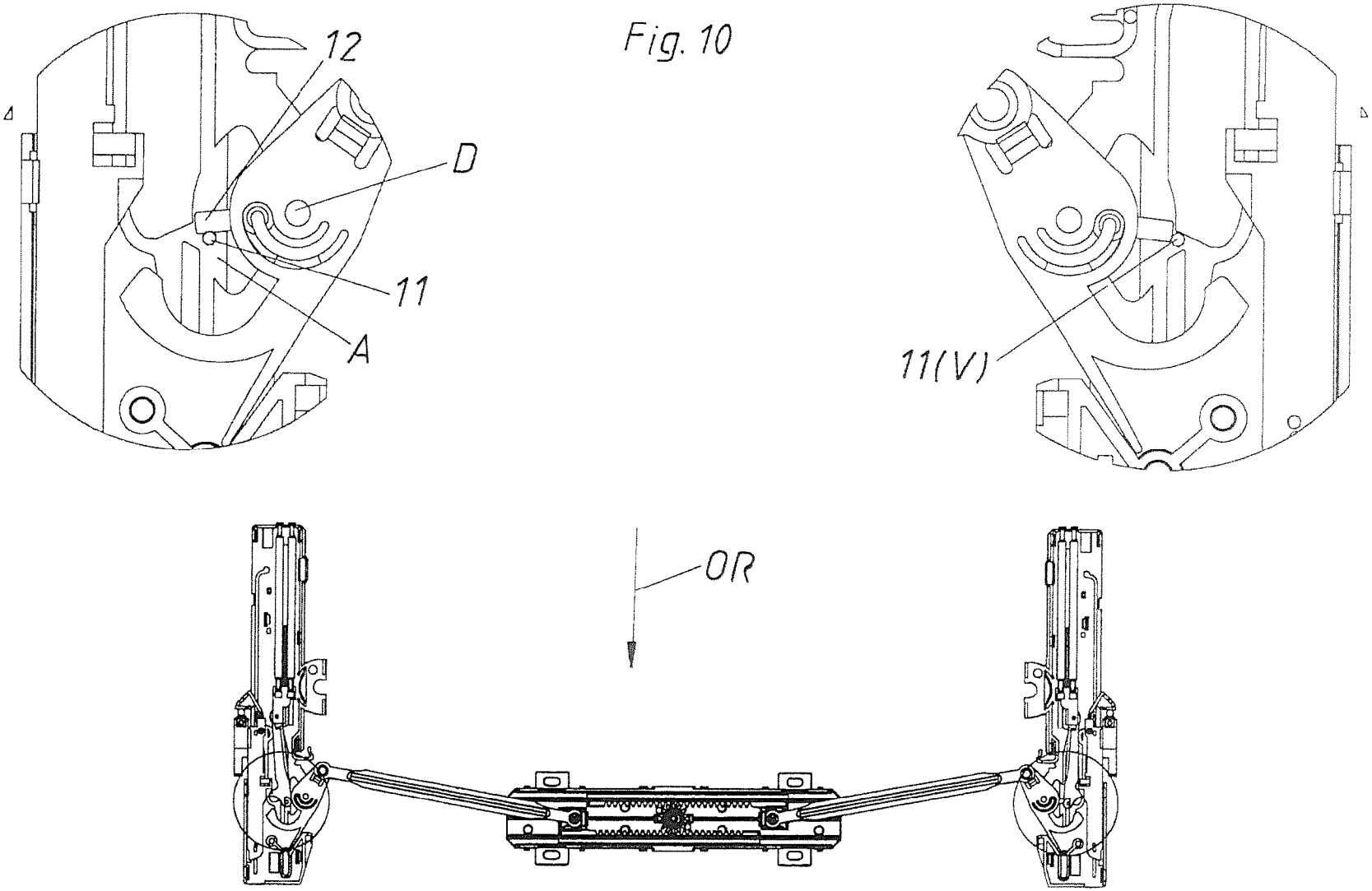

As soon as the moveable furniture part 3 is released, the ejection force storage members 10 of the first ejection device 4 can be relieved of stress. As a result, the housing 8 together with the moveable furniture part 3 fixed thereto is ejected relative to the entrainment member 21 in the opening direction OR (see FIG. 10) whereby the latching element 11 also passes into the ejection section A of the cardioidal sliding track 13. The first ejection device 4 therefore actually thrusts against the furniture carcass 19, more specifically the entrainment member 21. Up until then there has not been any transmission of movement to the synchronizing device 6. As shown in FIG. 10 however the latching element 11 already bears against the synchronizing surface 15 of the locking element 12. That synchronizing surface 15 is oriented radially relative to the axes of rotation D of the coupling elements 16*a* and 16*b*.

Figure 11:
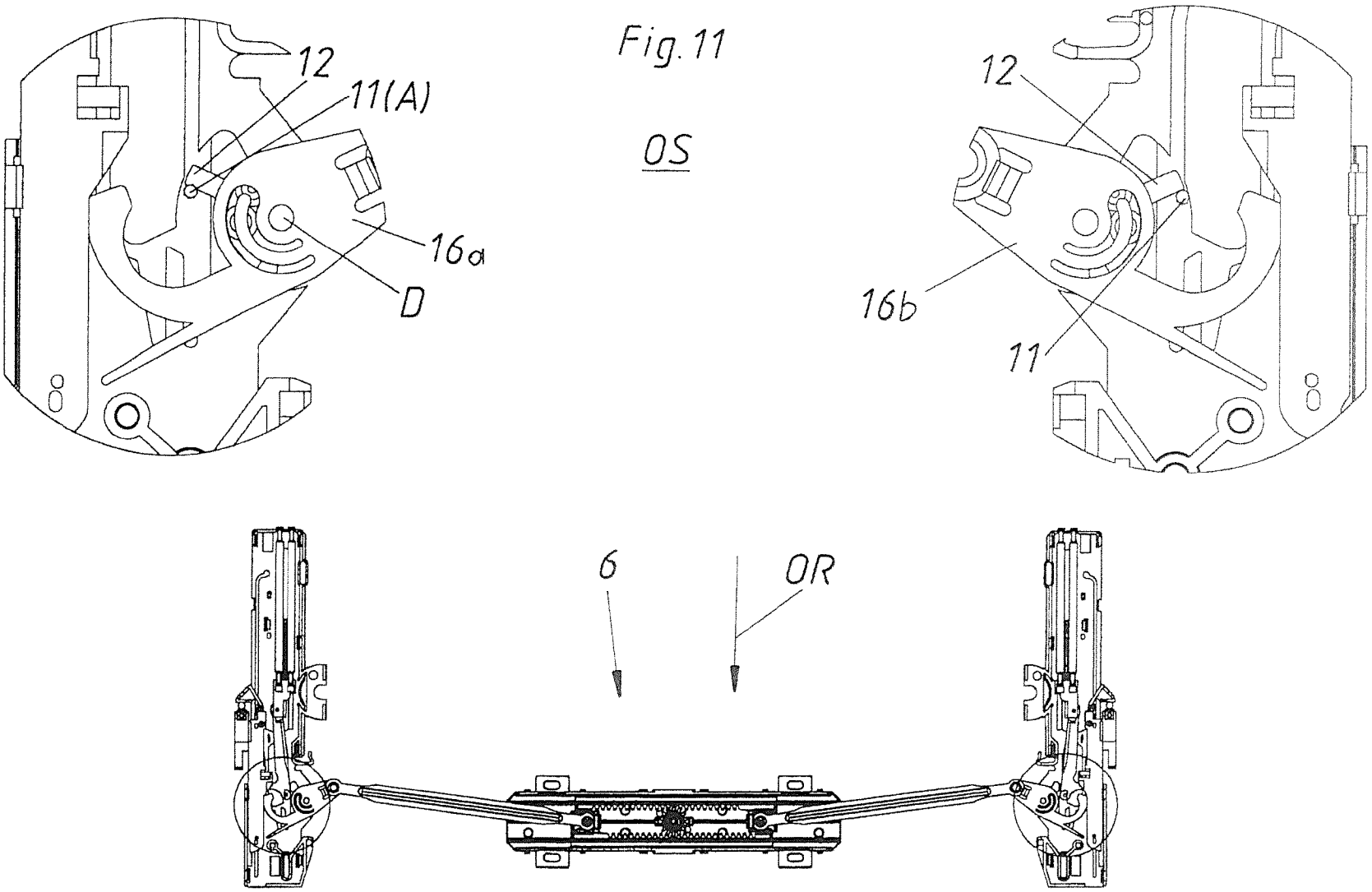

By virtue of that orientation of the synchronizing surface 15, finally—when the ejection force storage member 10 moves the latching element 11 further through the ejection section A in the opening direction into the position shown in FIG. 11—the transmission of movement from the first drive device 2 to the synchronizing device 6 and further to the second drive device 7 takes place. By virtue of the synchronizing effect the locking element 12 of the second drive device 7 is pivoted whereby the latching element 11 is no longer locked at the locking surface 14 thereof. Thus that latching element 11 passes directly from the locking section V into the ejection section A. Therefore the ejection force storage member 10 of the second ejection device 4 can also be relieved of stress and the moveable furniture part 3 is ejected synchronously into an open position OS by both ejection devices 4.

Figure 12:
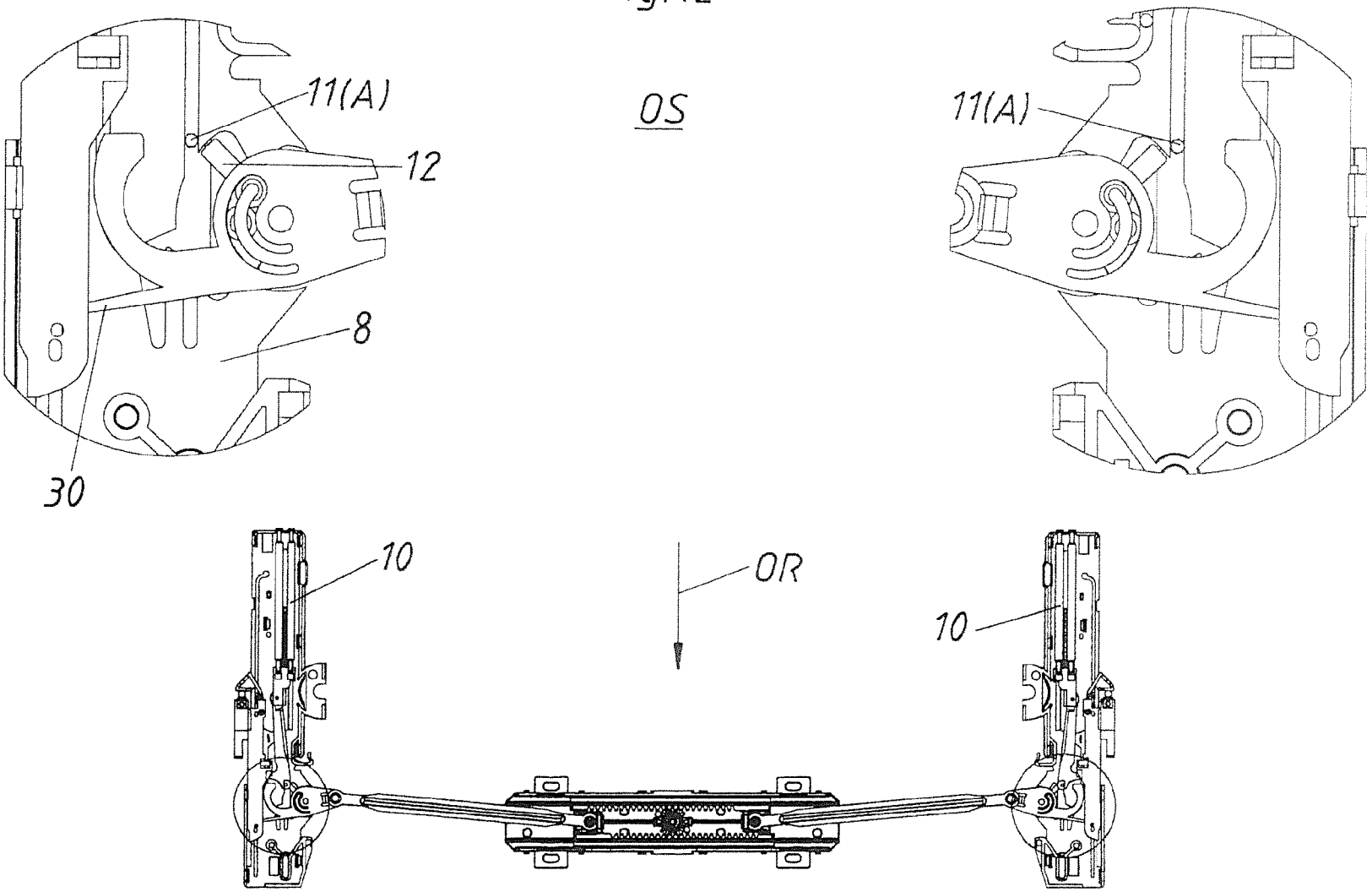

After further rotation of the two coupling elements 16*a* and 16*b* into the position shown in FIG. 12 the latching element 11 and the locking element 12 no longer bear against each other. The ejection force storage members 10 of both ejection devices 4 can be further relieved of stress. In comparison with FIG. 10, it is also possible to clearly see that the coupling element 16*a* and 16*b* have rotated through about 50° about the axes of rotation D. Preferably, that rotary movement is limited on the one hand by the locking element 12 coming into abutment against the housing 8 and on the other hand by the slightly elastic spring element 30 also coming into abutment against the housing 8. In general, depending on the respective design configuration, that rotary range can be between 30° and 90°. The relatively wide range of rotary movement gives the advantage that in particular the total clearance of the synchronizing device 6 has scarcely any influence on synchronization.

Figure 13:
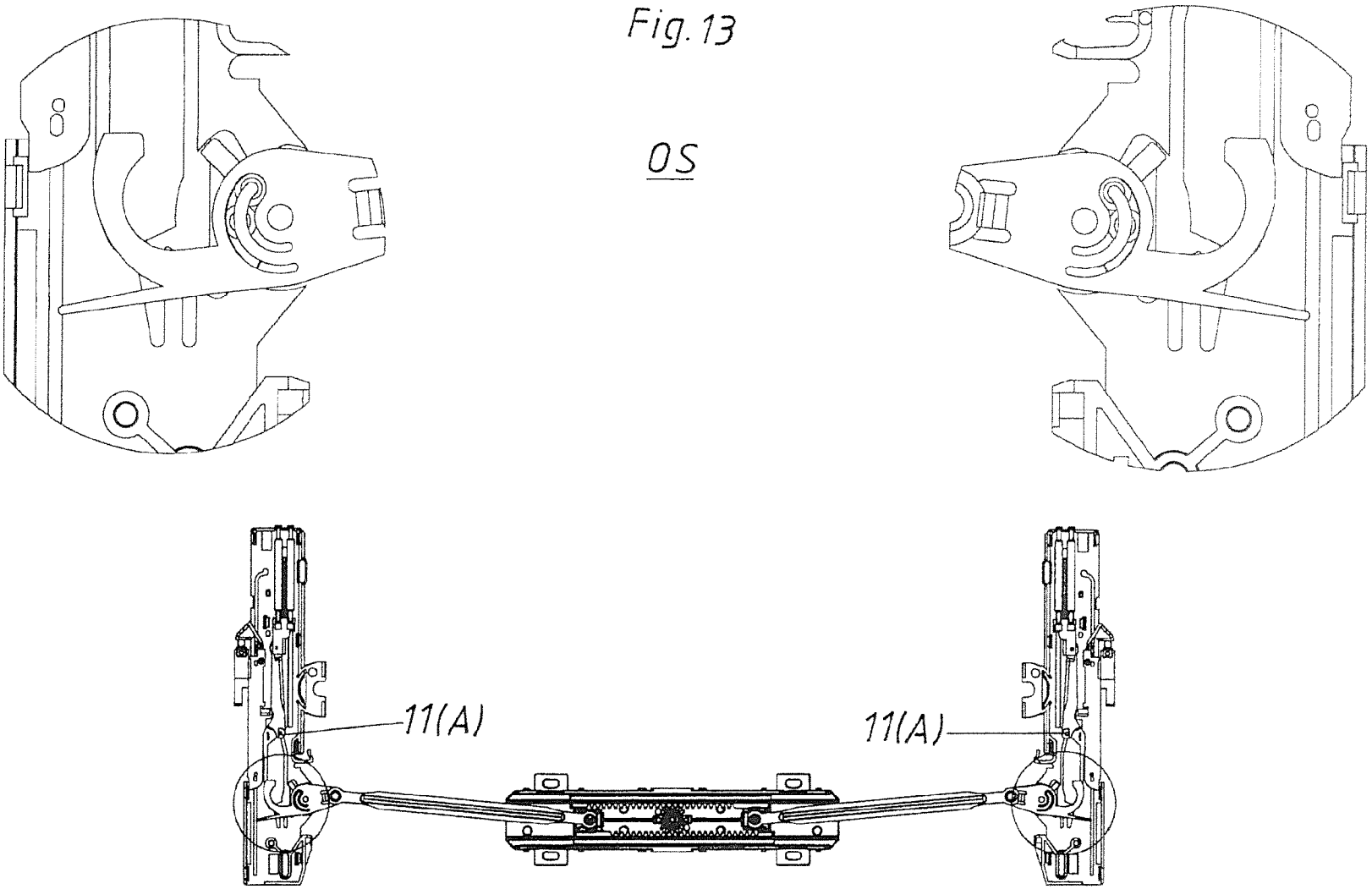

Finally, as shown in FIG. 13, both ejection force storage members 10 are fully relieved of stress and the ejection operation is concluded.

Figure 14:
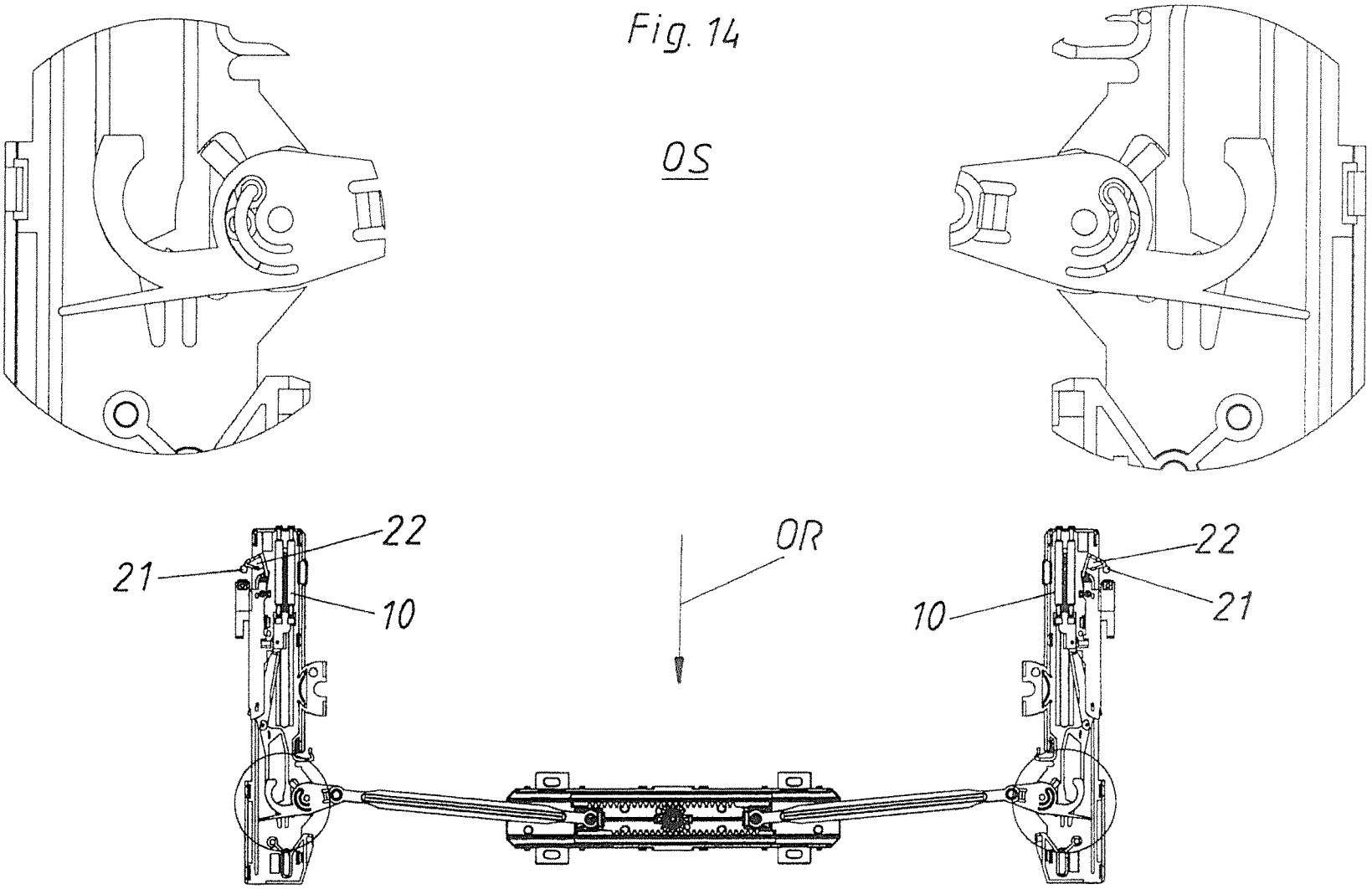

Then, due to momentum or by actively pulling on the moveable furniture part 3, the drive devices 2 and 7 pass into the position shown in FIG. 14. In that situation, the control lever 23 and the transmission element 20 are no longer in contact. The catch lever 22, however, is in the angled end section 34 of the control track 24 whereby the entrainment member 21 is released. The moveable furniture part 3 is thus freely moveable.

Figure 15:
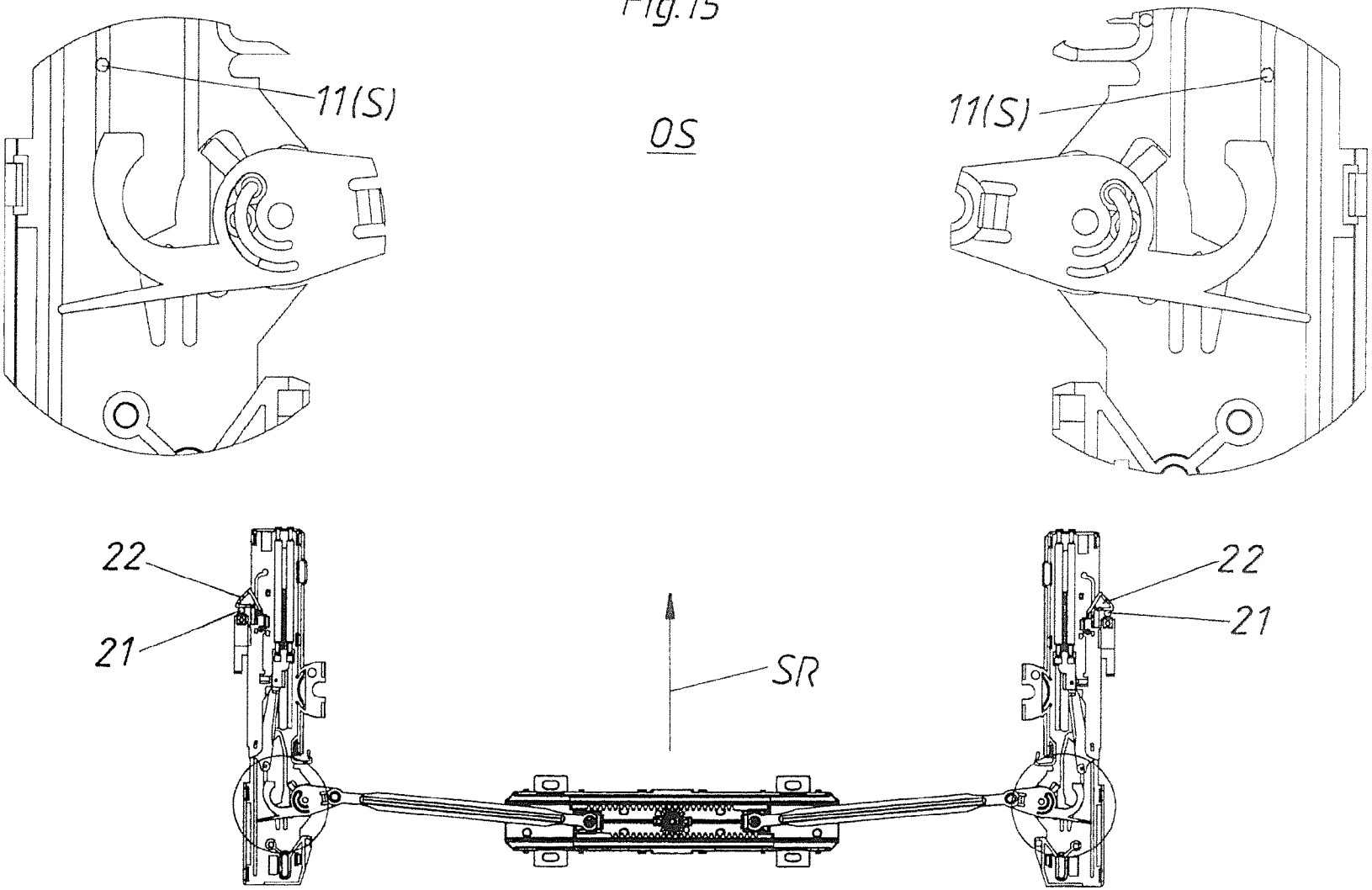

The closing process for the moveable furniture part 3 is shown as from FIG. 15. Here, the entrainment member 21 is caught again and by way of the transmission element 20, the control lever 23 and with same the latching element 11 are in the tensioning section S whereby the ejection force storage members 10 are manually tensioned upon closure.

Figure 16:
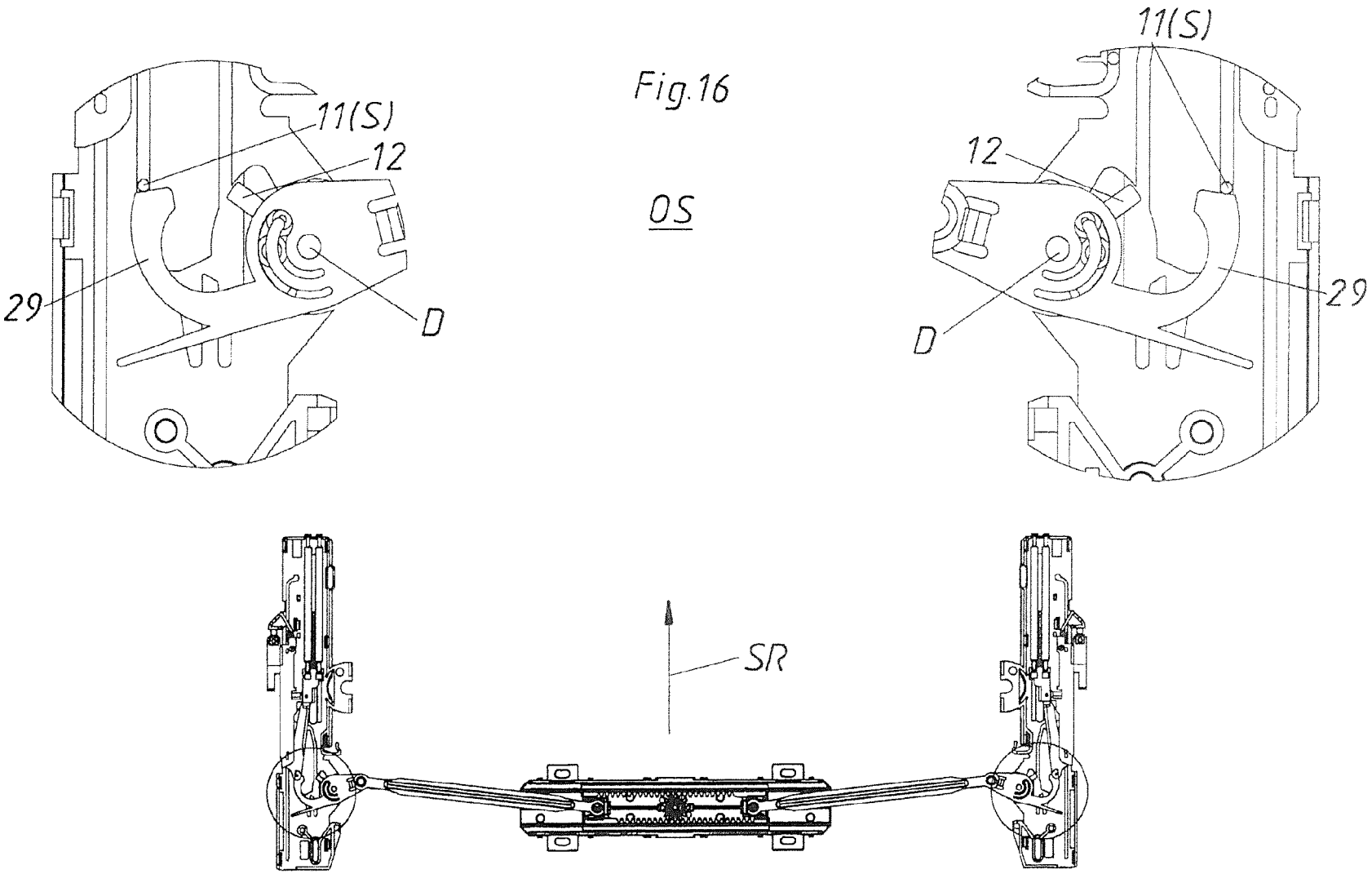
Figure 17:
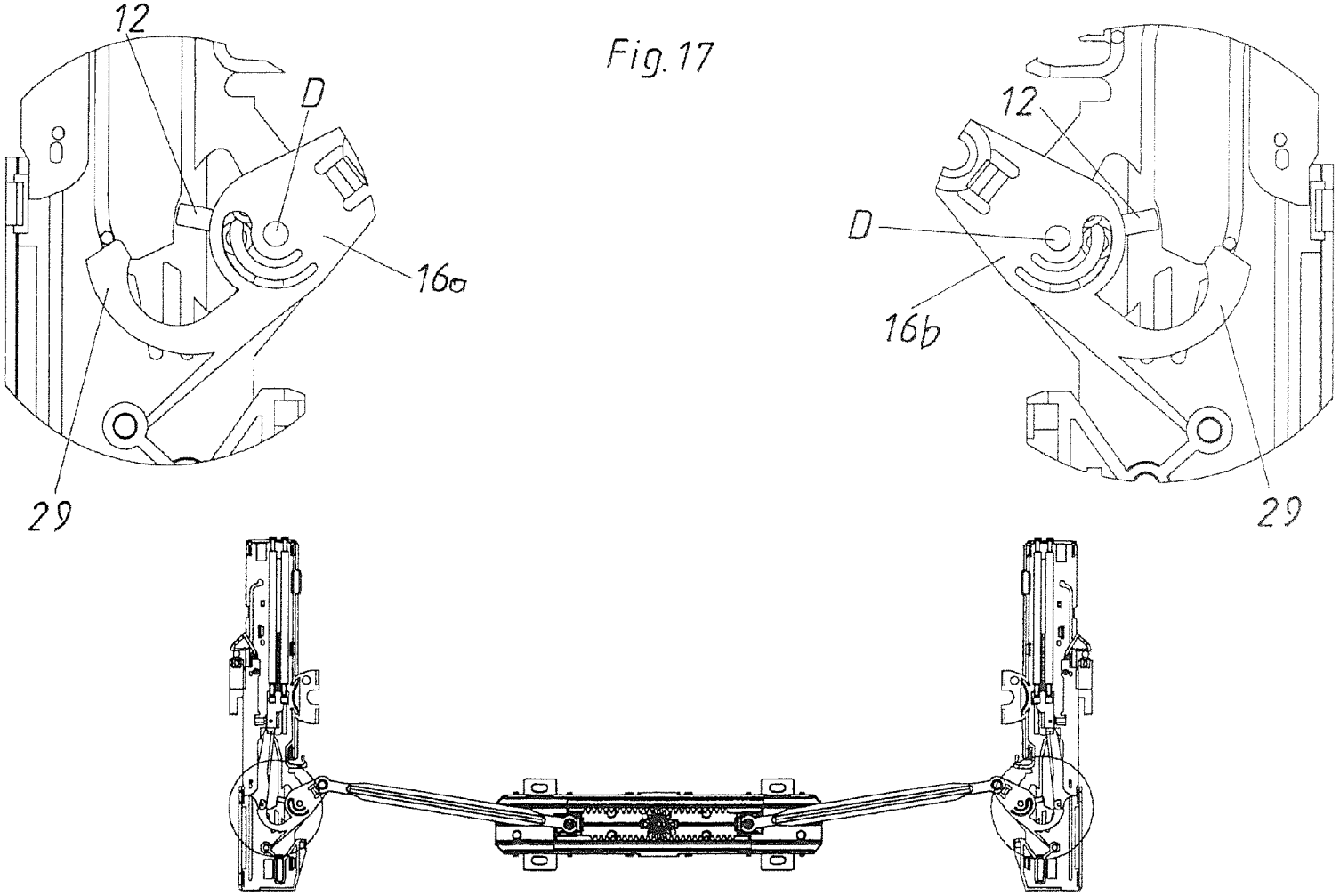

In that closing and stressing movement, both latching elements 11 as shown in FIG. 16 also come into abutting relationship with the return levers 29 of the coupling elements 16. In that way the coupling elements 16*a* and 16*b* are rotated about the axes of rotation D so that as shown in FIG. 17 the locking elements 12 also move closer and closer in the direction of the locking section V.

Figure 18:
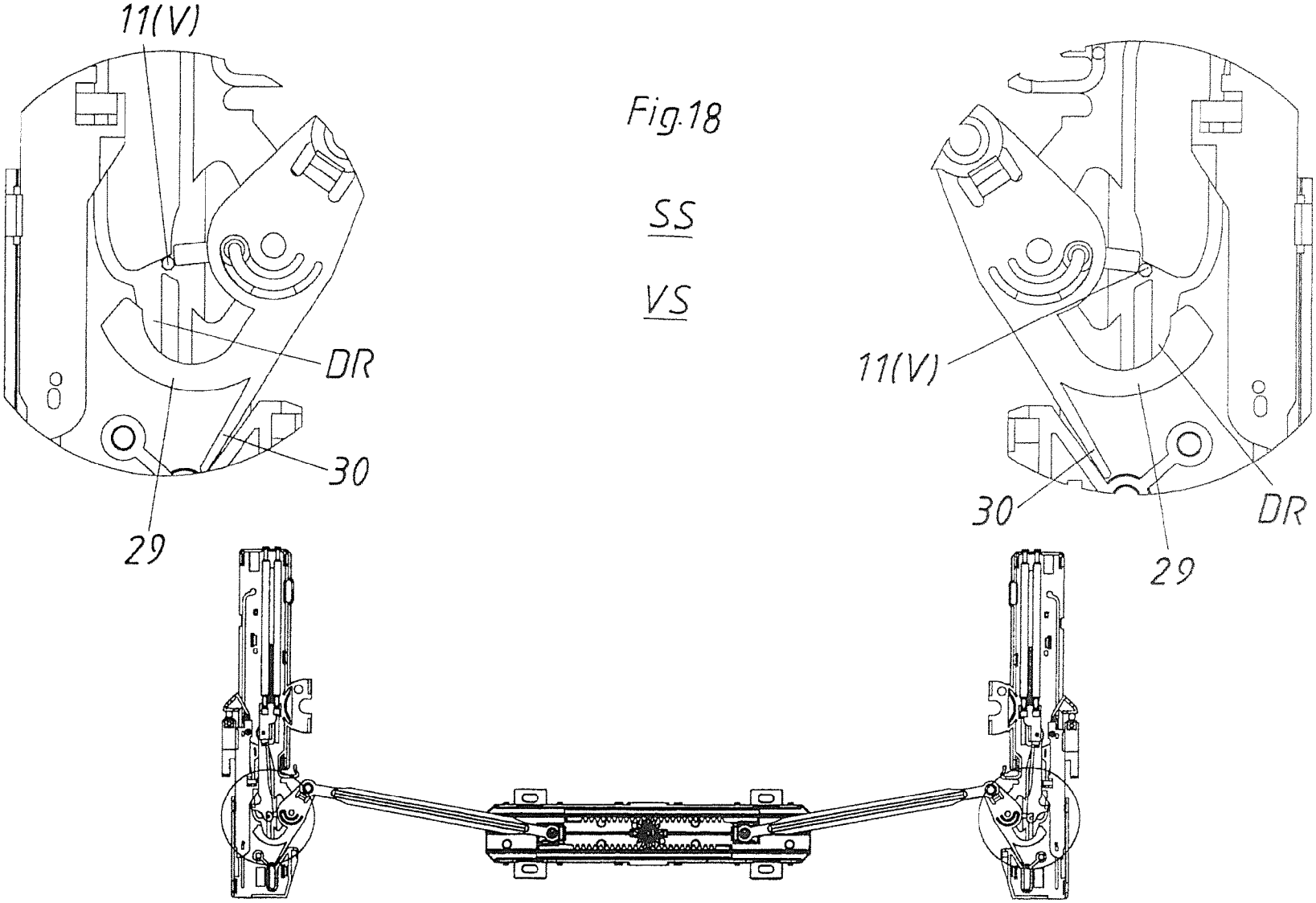

In FIG. 18, finally the coupling elements 16*a* and 16*b* are again in their starting position so that the locking surfaces 14 of the locking elements 12 again serve for locking the latching elements 11. The slightly elastic elements 30 of the coupling elements 16 provide for correct positioning (neutral position) of the locking elements 12 so that the locking elements 12 also form the latching depression or the locking section V. The locking position VS of the ejection devices 4 is again reached with the ejection force storage members 10 in a stressed condition. The moveable furniture part 3 is again in the closed position SS. To guarantee that the coupling elements 16*a* and 16*b* remain in their position—after the latching element 11 is no longer in contact with the return lever 29 and before the latching element 11 again bears against the locking element 12—small latching noses can be provided in the housing 8, the noses cooperating with the coupling element 16*a* and 16*b*, preferably with their locking elements 12.

Figure 19:
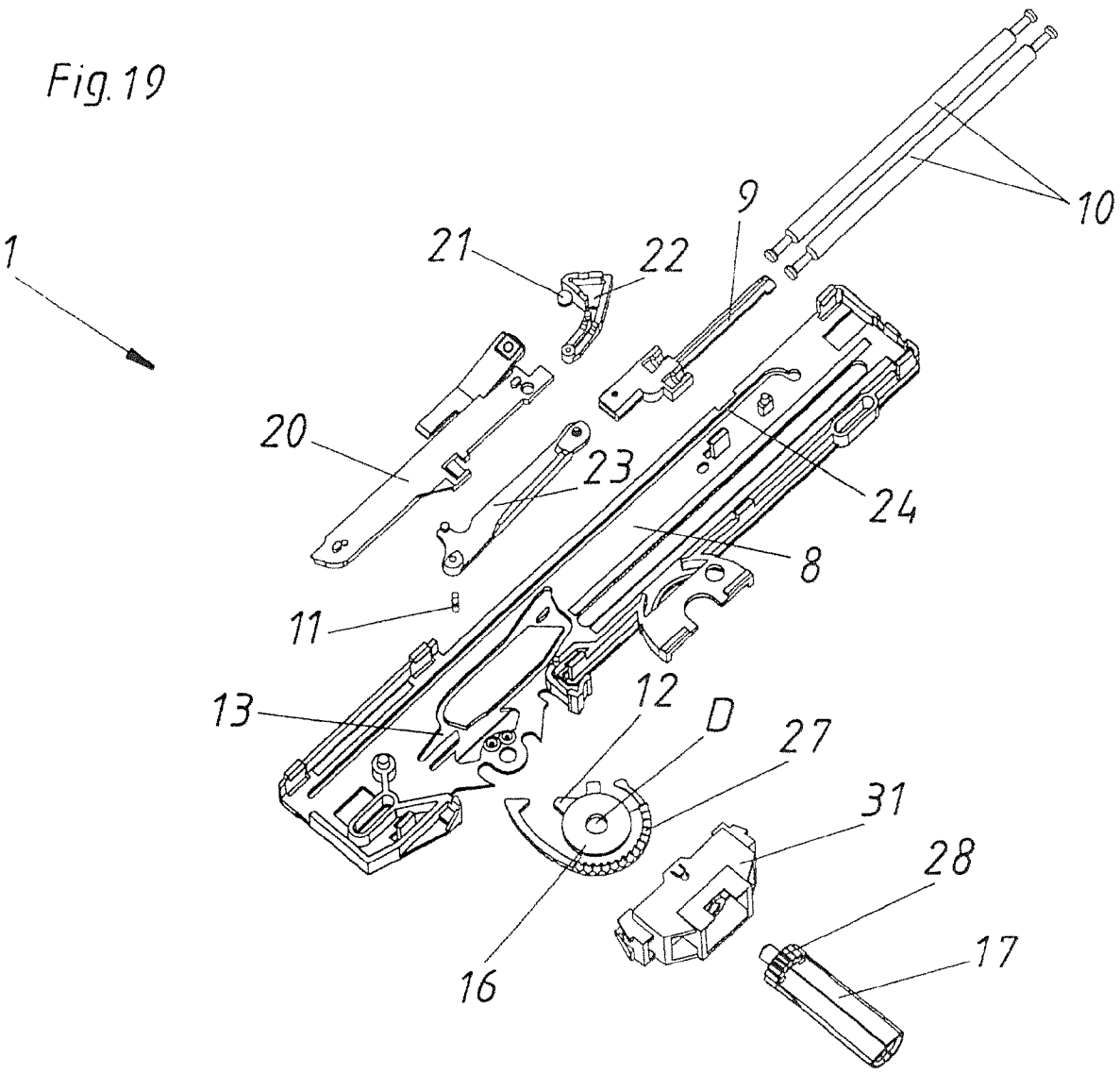
FIG. 19 is an exploded view of an alternative configuration of the arrangement.
Figure 21B:
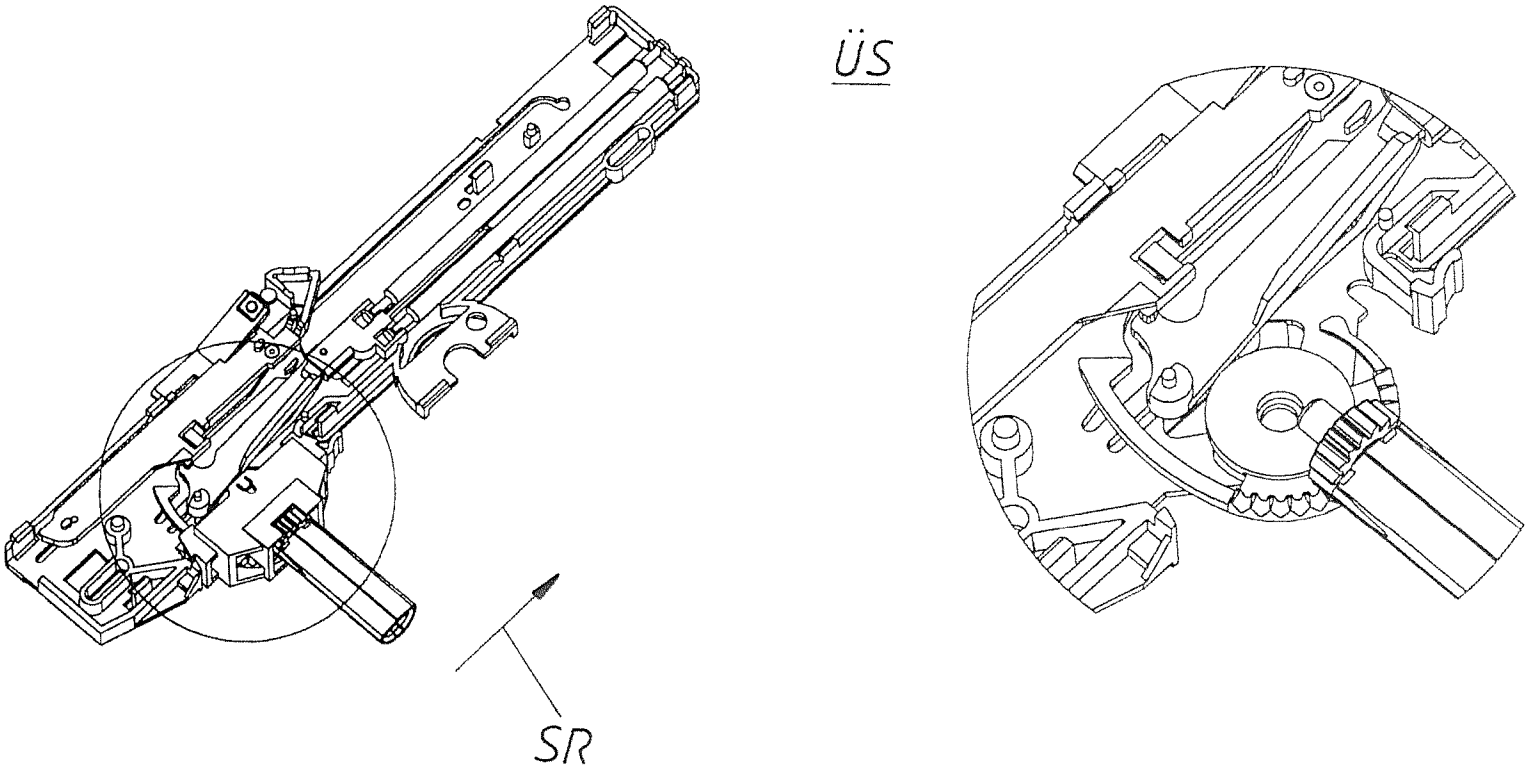
Figure 22B:
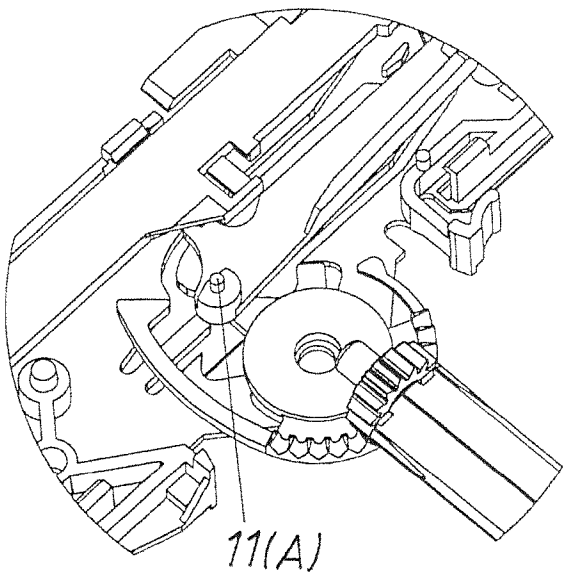
Figure 22B:
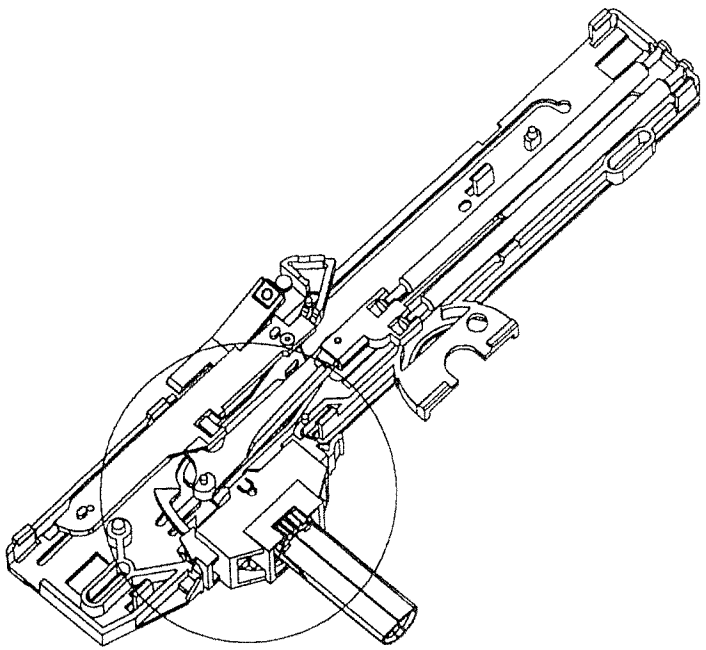
Figure 23A:
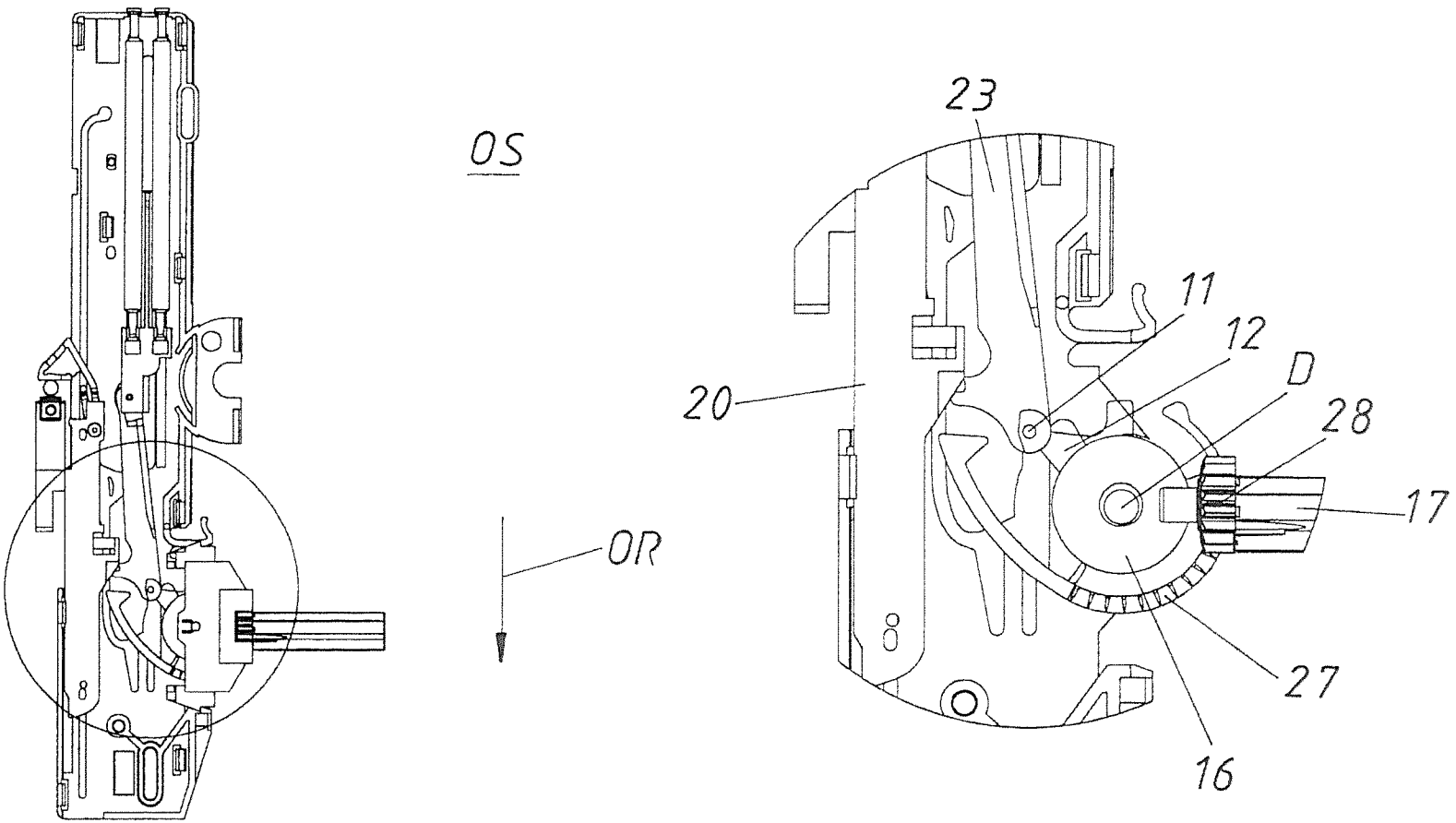
Figure 23B:
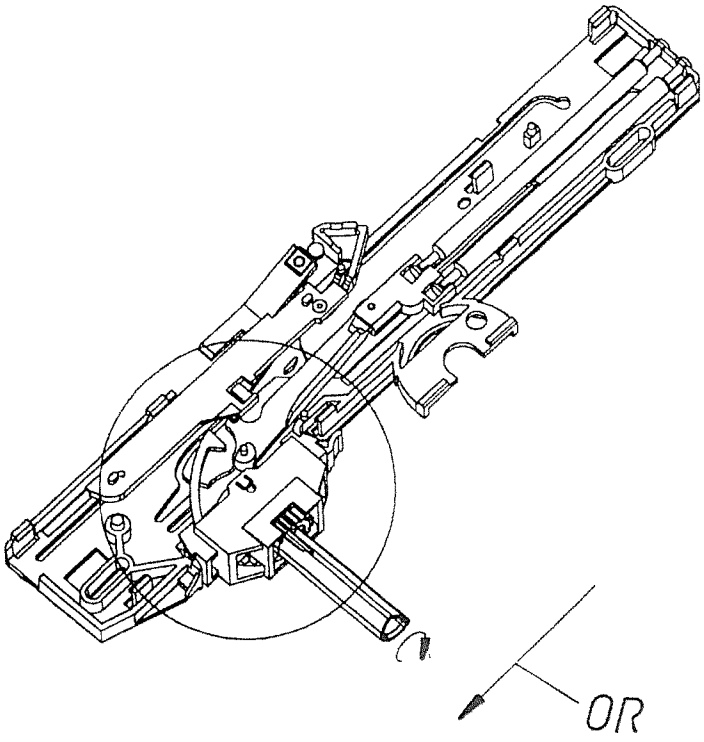
Figure 23B:
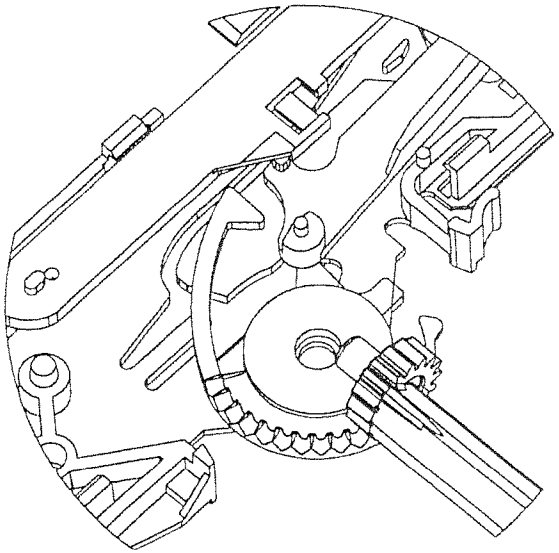

FIG. 19 shows an exploded view of an alternative embodiment of the synchronizing device 6. In accordance therewith, the gear rack 27 is provided directly on the coupling element 16. Fixed to the housing 8 is a holder 31 to which the synchronizing rod 17 is rotatably mounted together with a gear wheel 28 at the end thereof. The gear wheel 28 meshes with the gear rack 27 so that a rotary movement of the coupling element 16 is transmitted into a rotary movement of the synchronizing rod 17—and vice-versa. The remaining components of the arrangement 1 in FIG. 19 are identical to the first embodiment.

FIGS. 20A through 23B again show—matching with FIG. 19—the most important positions involved in the motion sequences of the drive device 2 and 7 respectively and the synchronizing device 6. The rotary movement of the synchronizing rod 17 is most clearly shown in FIG. 23B.

In the FIGS. 24 to 27, a problem is explained in detail which sometimes occurred with previous arrangements 1 with two drive devices 2 and 7 and a synchronizing device 6.

Figure 24:
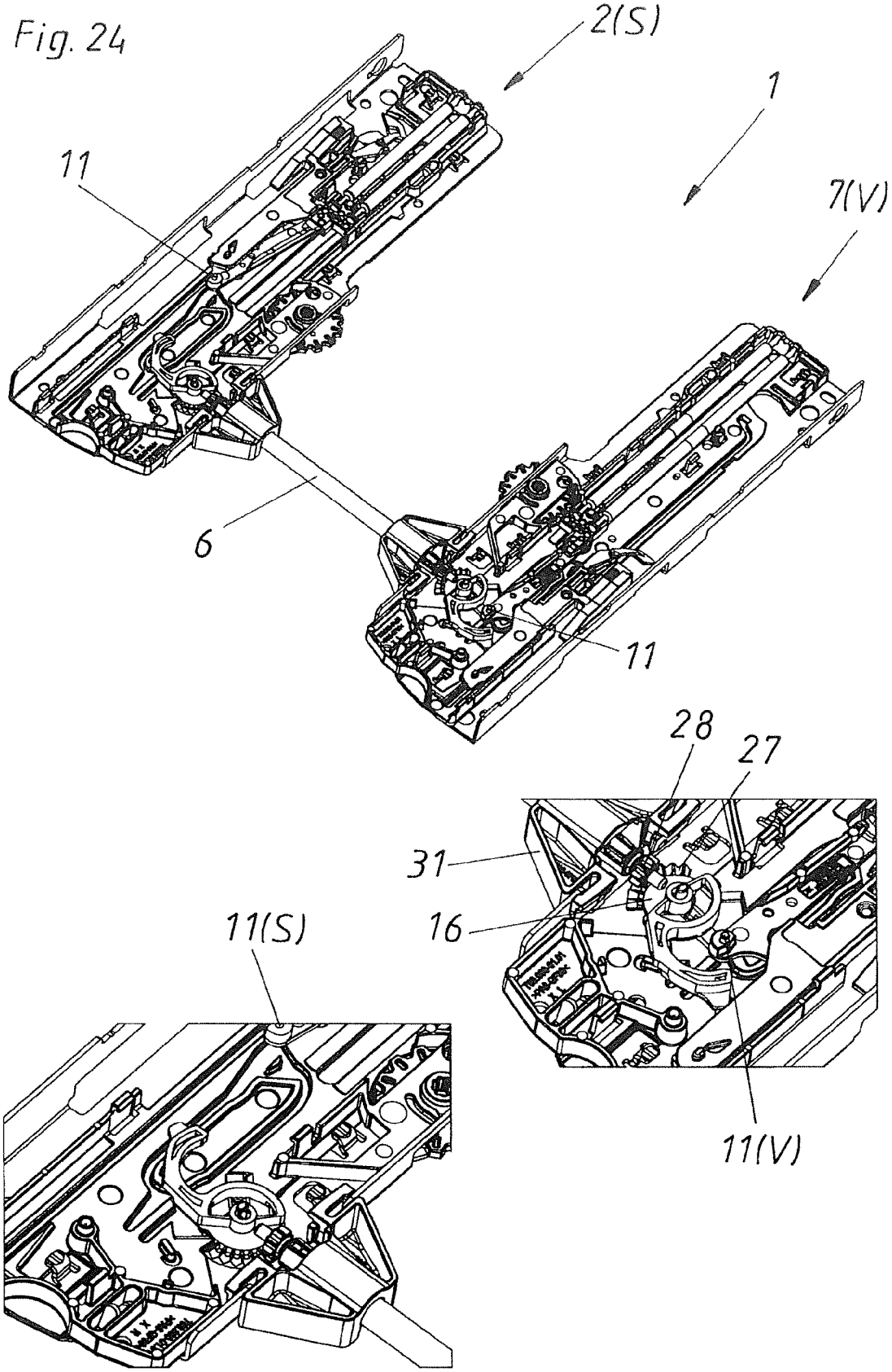

By an incorrect operation or by mounting drive devices 2 and 7 located in positions different from each other it could have occurred that—as for example illustrated in FIG. 24—the first drive device 2 assumes a position at the beginning of the tensioning section S whereas the second drive device 7 assumes a position at the end of the locking section V. Put in other words the two drive devices 2 and 7 are located in different positions. The respective positions can be best seen by means of the position of the respective latching element 11 in the cardioidal sliding track 13. In concrete, the latching element 11 of the first drive device 2 is at the end of the ejection section A which at the same time forms the beginning of the tensioning section S (see detail bottom left). The latching element 11 of the second drive device 7 is at the end of the locking section V (see detail bottom right), thus, in the latching recess of the cardioidal sliding track 13).

Figure 25:
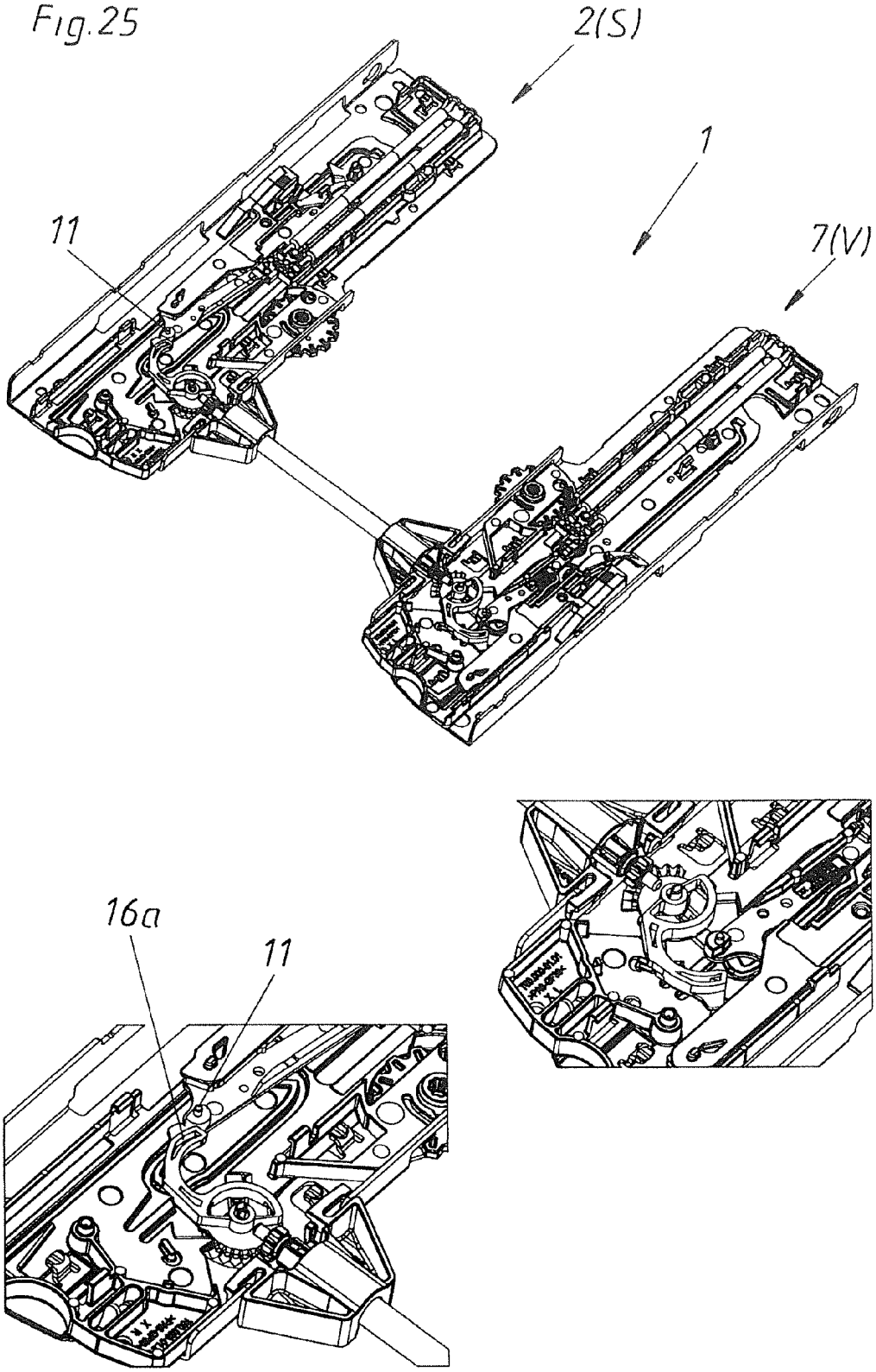

If now pressing onto the still opened moveable furniture part 3 starting from this false position, so in the drive device 2 the transmission element 20 and with this transmission element 20 the control lever 23 together with the latching element 11 is moved relative to the housing 8 because auf the fixed entrainment member 21. As a result the position according to FIG. 25 is reached. Here, the latching element 11 has already travelled a part of the tensioning section S. The latching element 11 and its control lever 23 respectively are thus already bearing against the first coupling element 16*a* (see especially the detail section bottom left). The latching element 11 of the second drive device 7 is still located in the latching recess of the locking section V (see especially the detail section bottom right).

Figure 26:
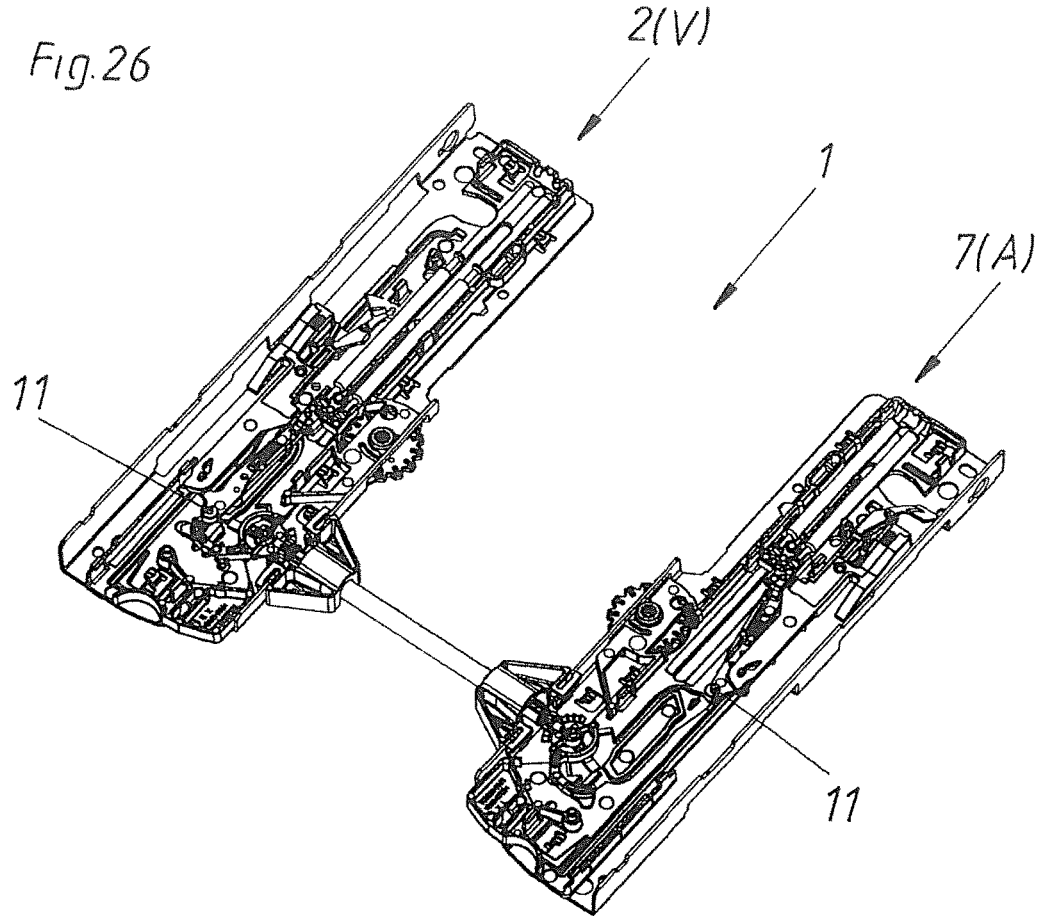
Figure 26:
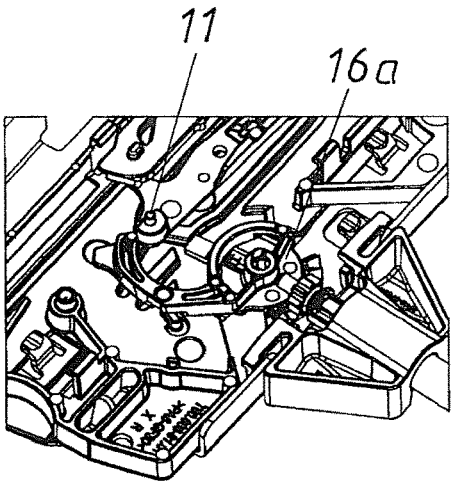
Figure 26:
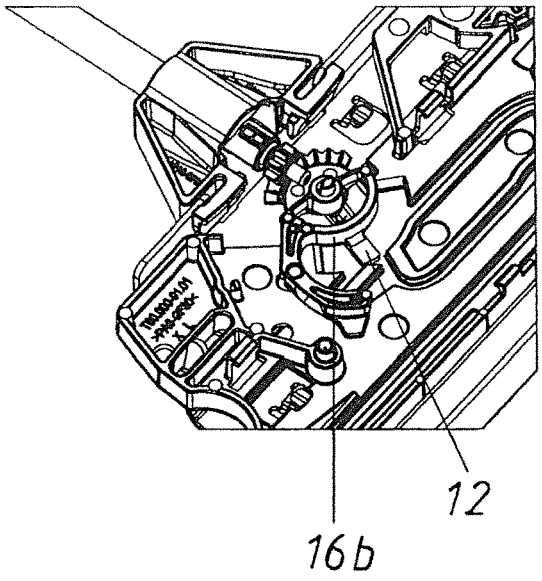

As soon as in a case of a further movement in closing direction SR the first coupling element 16*a* of the first drive device 2 begins to rotate due to the moving control lever 23, a movement transmission to the second coupling element 16*b* of the second drive device 7 is carried out by the synchronizing device 6, wherein the second coupling element 16*b* is thus rotated clockwise. This also induces a movement of the locking element 12 formed in one piece with the second coupling element 16*b*, whereby the latching recess is opened and the locking position VS is unset. As a result, the ejection force storage member 10 of the second drive device 7 can relax and thereby moves the ejection slider 9 through the ejection section A. Hence, the second drive 7 is located—as shown in FIG. 26—in a position at the end of the ejection section A while the first drive device 2 is located in a position at the beginning of the locking section V.

Figure 27:
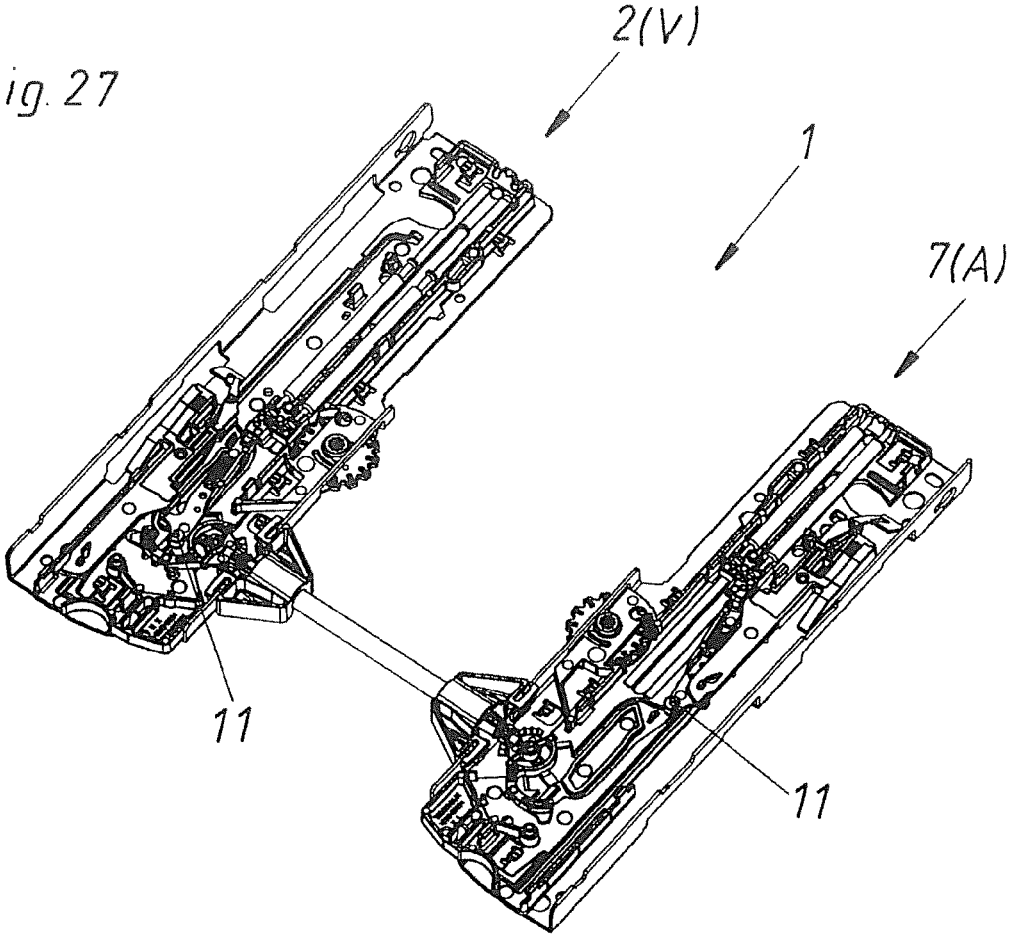
Figure 27:
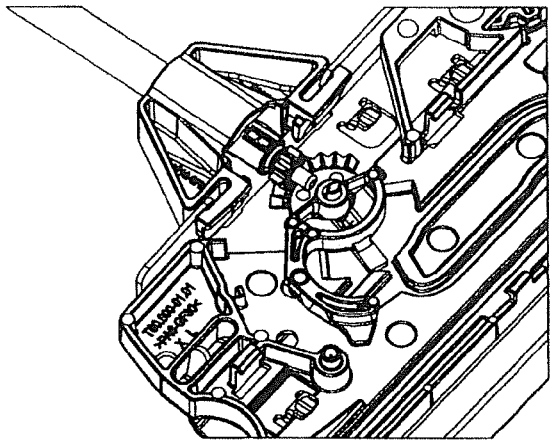
Figure 27:
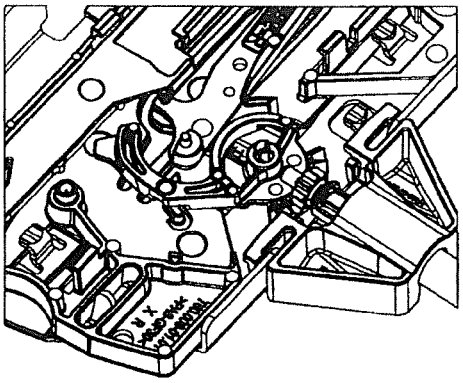

In FIG. 27 the latching element 11 of the first drive device 2 has finally reached the end of the locking section V.

This undesired false synchronization is corrected by the present invention, wherein this is explained in the following by reference to the preferred embodiment according to the FIGS. 28 to 40.

Figure 28A:
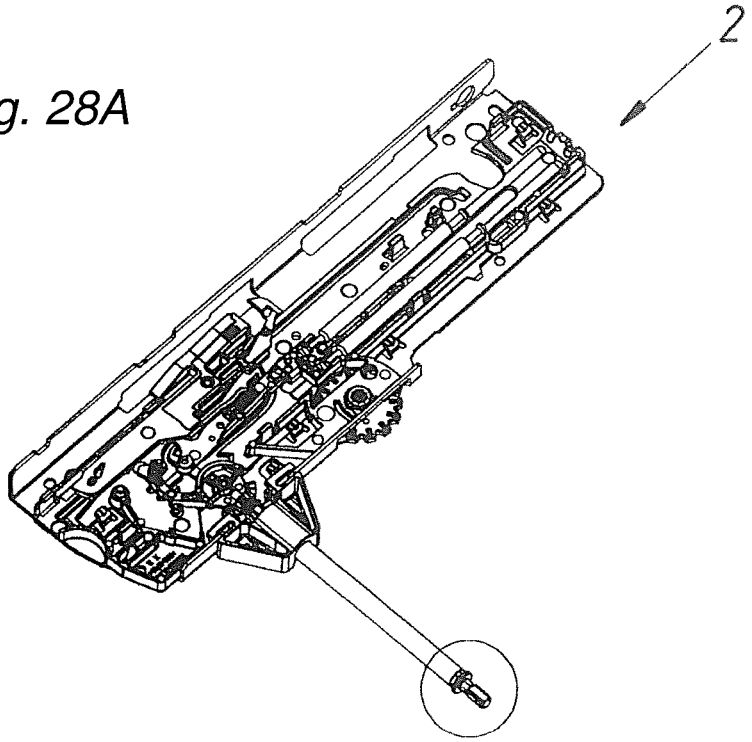
FIGS. 28A to 35C show various perspectives and sections of components of an embodiment of a synchronizing device according to the invention.
Figure 28B:
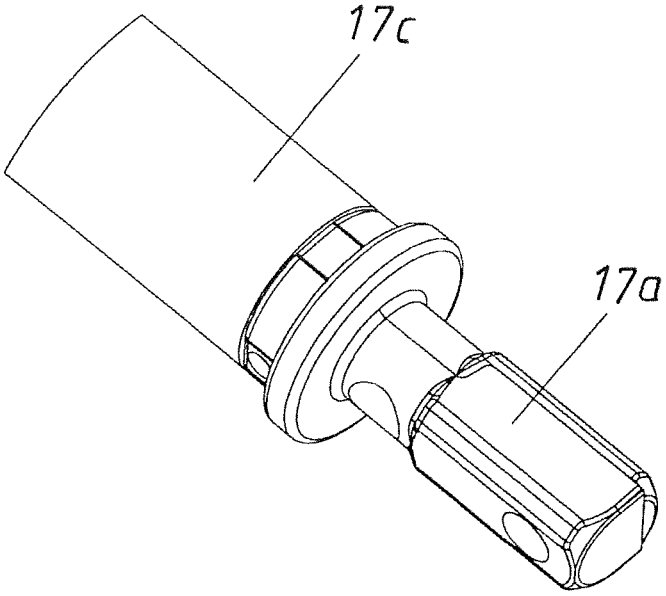

In FIGS. 28A-28B, the components of the synchronizing device 6 are exemplified. Especially, the first rod member 17*a* can be seen which is inserted into the third, profile-shaped or extrusion-pressed rod member 17*c*.

Figure 29A:
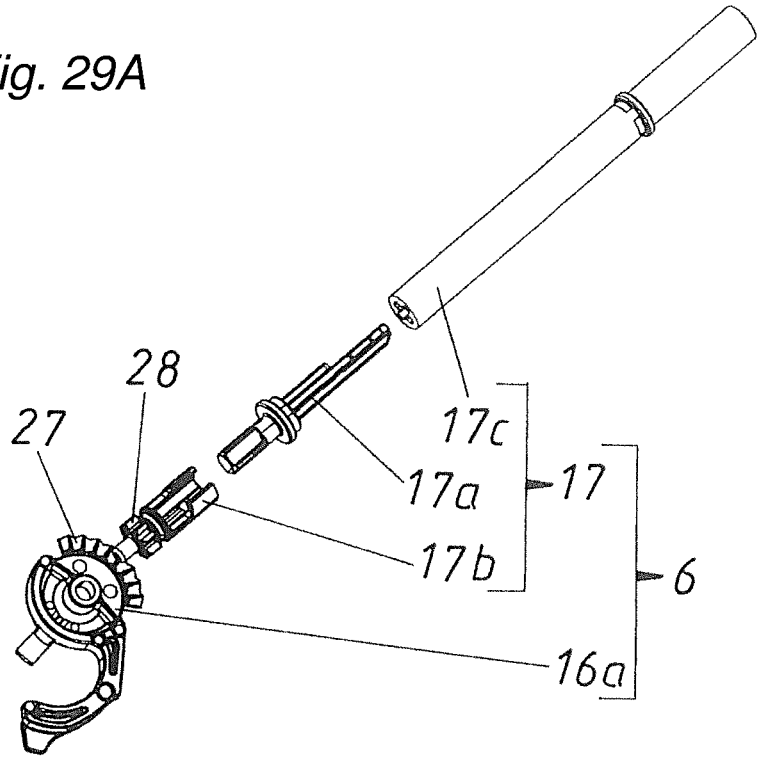
Figure 29B:
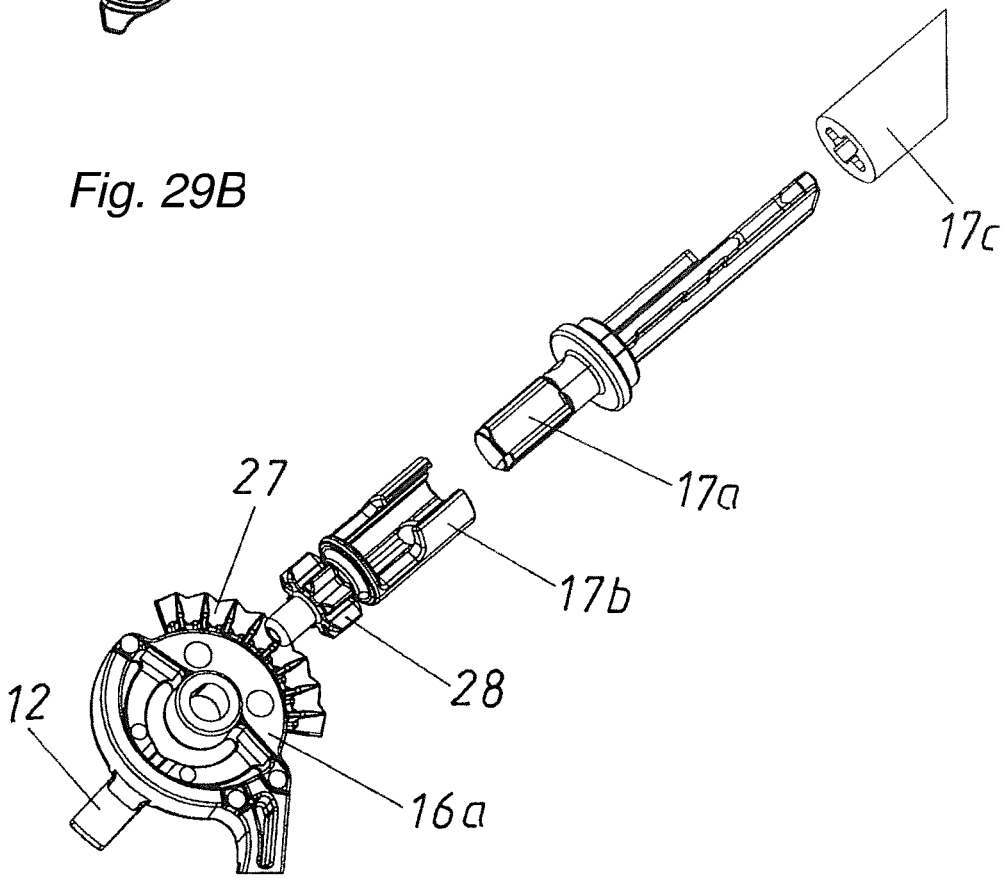

As follows from FIGS. 29A-29B, the two rod members 17*a* and 17*c* together with the second rod member 17*b* form the synchronizing rod 17. At the other end of the third rod member 17*c* two further and structurally identical rod members 17*a* and 17*b* are provided. The synchronizing rod 17 together with the coupling elements 16*a* and 16*b* forms the synchronizing device 6. In the larger displayed FIG. 29B the gear rack 27 formed on the first coupling element 16*a* and the gear wheel 28 formed on the second rod member 17*b* can be seen.

Figure 30A:
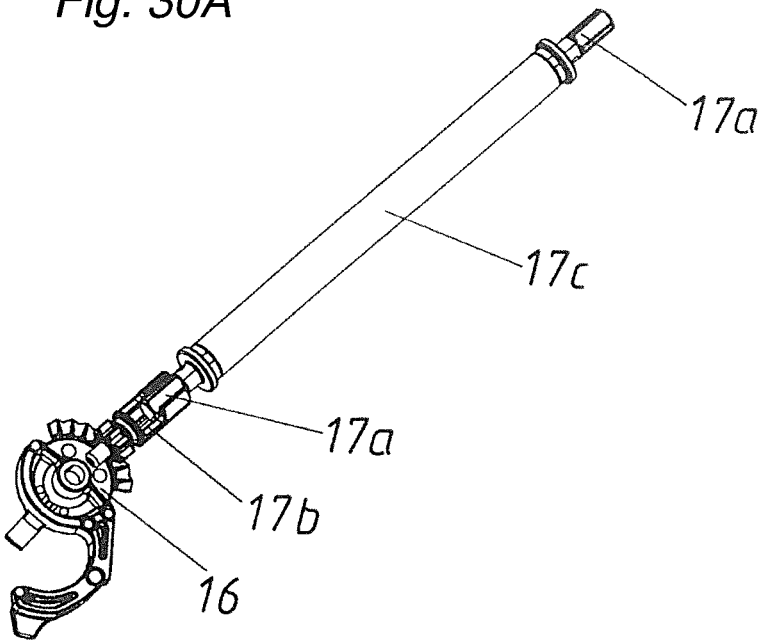
Figure 30B:
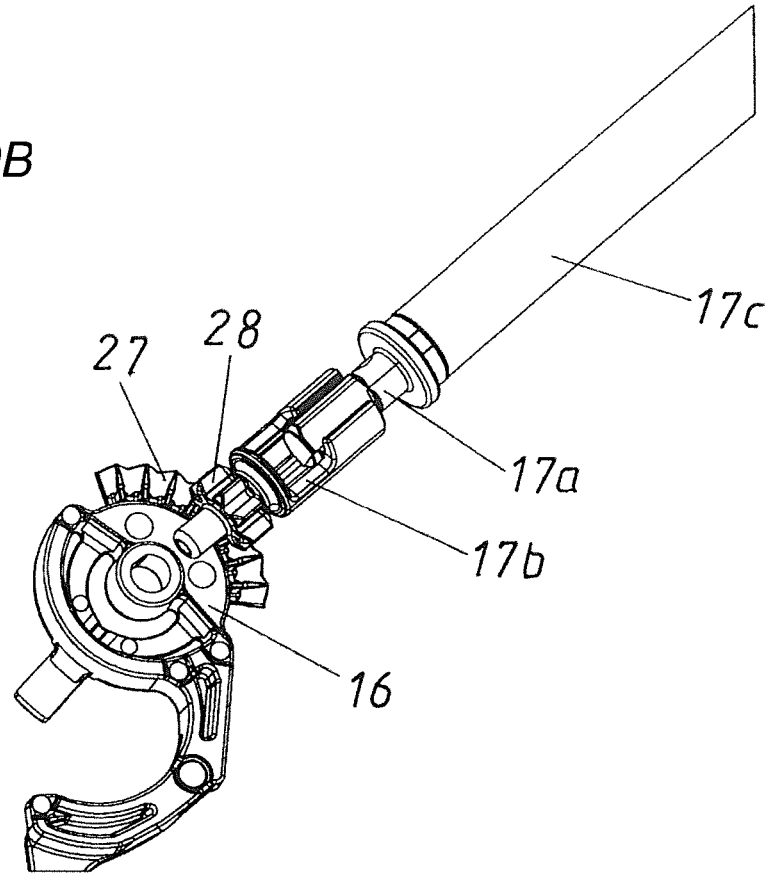

In the assembled state according to FIGS. 30A and 30B, the gear rack 27 and the gear wheel 28 are meshing. The first rod member 17*a* is inserted via its anterior portion into the second rod member 17*b*.

Figure 31C:
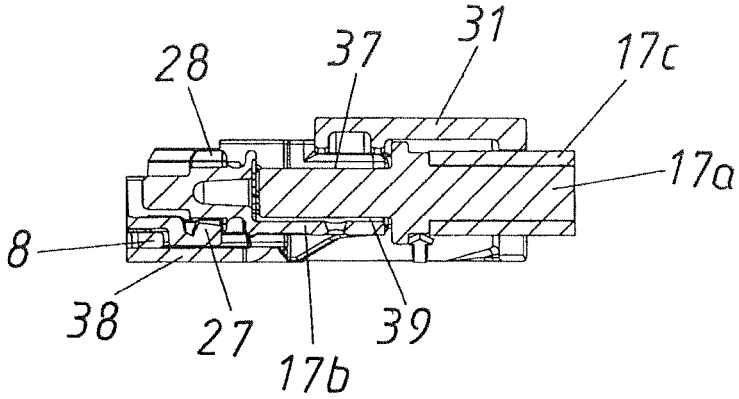
Figure 31B:
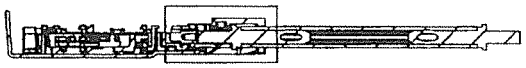
Figure 31A:
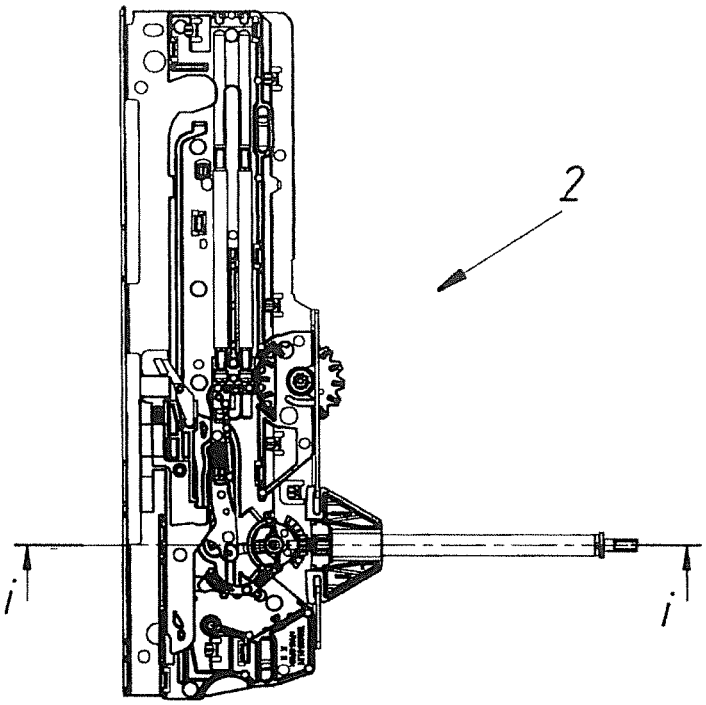

In FIG. 31A, the synchronizing device 6 is attached to the first drive device 2. The inscribed cross-section i-i is shown in FIG. 31B. FIG. 31C shows a detail of FIG. 31B. From this cross-section it can be recognized that the first rod member 17*a* is fixed or inserted exactly fitting and thus frictionally engaged in the third rod member 17*c*. In the same manner, the first rod member 17*a* is also inserted in the second rod member 17*b*. In that situation the frictional engagement is reached by means of the contact surface 37. At the same time, however, a clearance 39 partially remains between the first rod member 17*a* and the second rod member 17*b*. The housing 8 of the first drive device 2 can also be seen to some extent in FIG. 31C, which housing 8 is mounted by means of the mounting plate 38 to a moveable furniture part 3 which is not shown. On the housing 8, in turn, the first coupling element 16*a* is rotationally mounted which meshes by means of the gear rack 27 with the gear wheel 28 of the second rod member 17*b*. The holder 31 is attached to the housing 8 and forms a pivot bearing for the synchronizing rod 17.

Figure 32C:
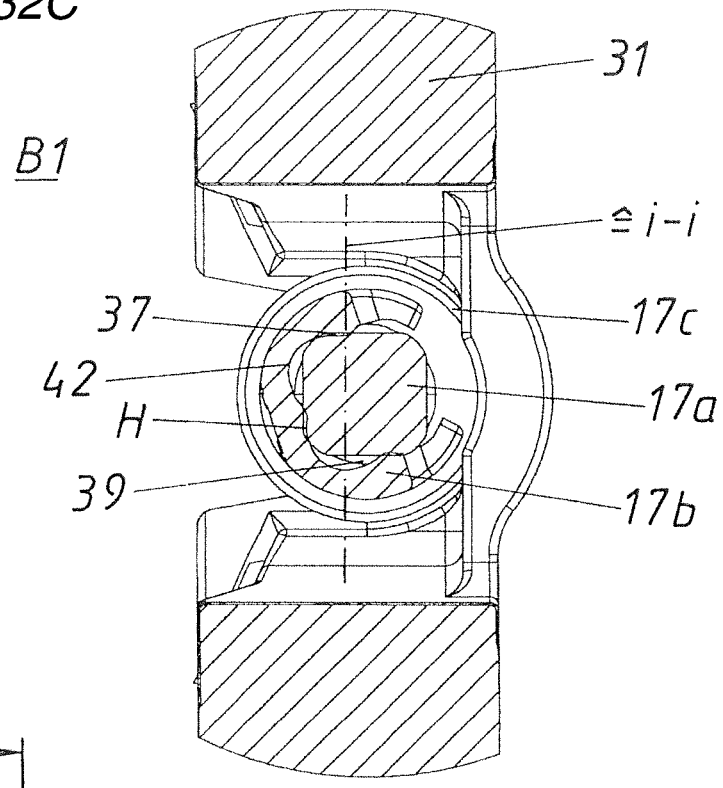
Figure 32A:
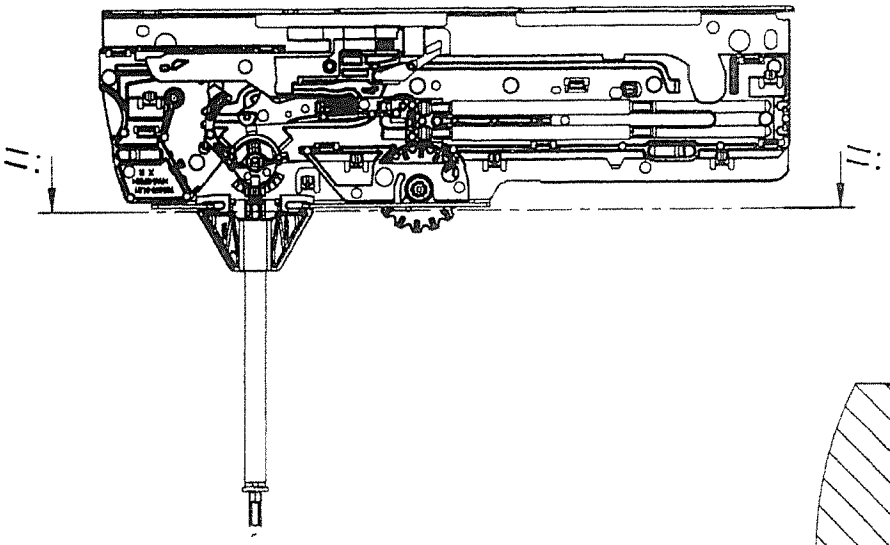
Figure 32B:
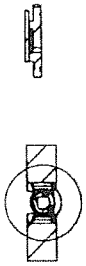

In FIG. 32A the cross-section ii-ii is inscribed which is shown in FIG. 32B. FIG. 32C shows a detail of FIG. 32B wherein it can be recognized that the anterior part of the first rod member 17*a* in the cross-section is formed quadrangular with rounded corners. In the cross-section the second rod member 17*b* comprises three convex parts 42. Thereby, the first rod member 17*a* does not bear against the second rod member 17*b* in the full circumference. Rather, this results in the clearances 39 next to the contact surfaces 37. The dot-dashed inscribed cross-section in that situation substantially corresponds to the cross-section i-i which is shown in FIG. 31C and also exemplifies the contact surface 37 and the clearance 39. In this FIG. 32C the rod members 17*a* and 17*b* have a first operating position B1 to each other. In this first operating position B1 a predetermined holding torque H is given between the rod members 17*a* and 17*b* due to the friction in the area of the contact surfaces 37.

Figure 33C:
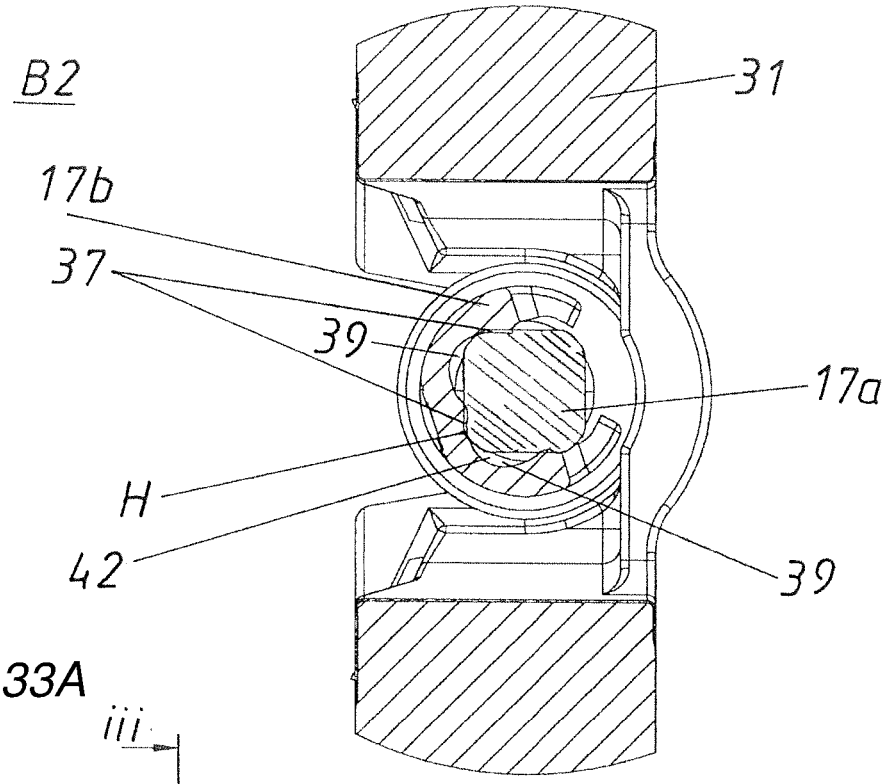
Figure 33A:
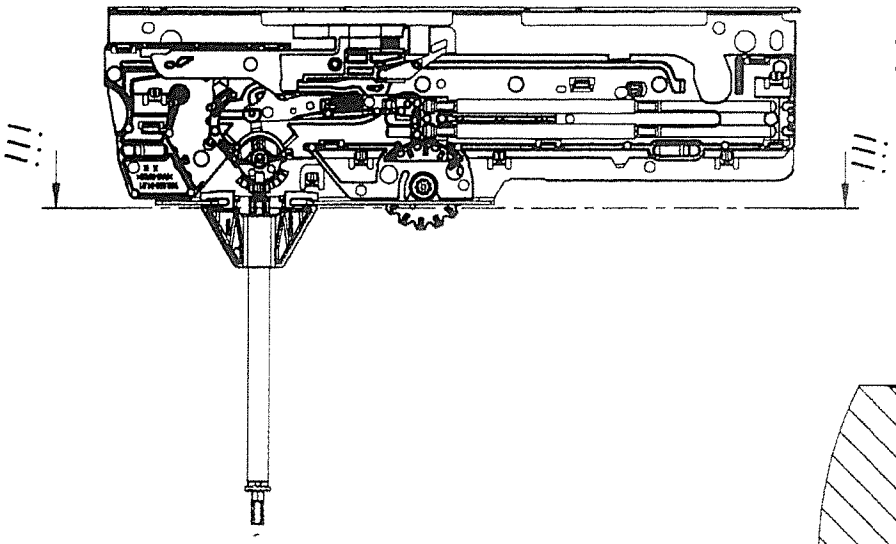
Figure 33B:
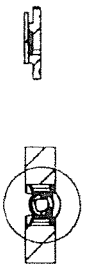

In FIG. 33A, the cross-section iii-iii is inscribed which is shown in FIG. 33B. FIG. 33C shows a detail of FIG. 33B wherein the first rod member 17*a* and the second rod member 17*b* together form the correction device 50 as the first rod member 17*a* can be rotated to the second rod member 17*b*. In concrete in FIG. 33C the first rod member 17*a* has rotated to the second rod member 17*b* compared to FIG. 32C (exemplified by the differently oriented hatching). This means the first rod member 17*a* has overcome the holding torque H in the area of the contact surfaces 37 and has rotated (in this case about 90°) relative to the second rod member 17*b* into the second operating position B2. In this second operating position B2 the holding torque H in the area of the contact surfaces 37 is again as large as in the first operating position B1.

Figure 32D:
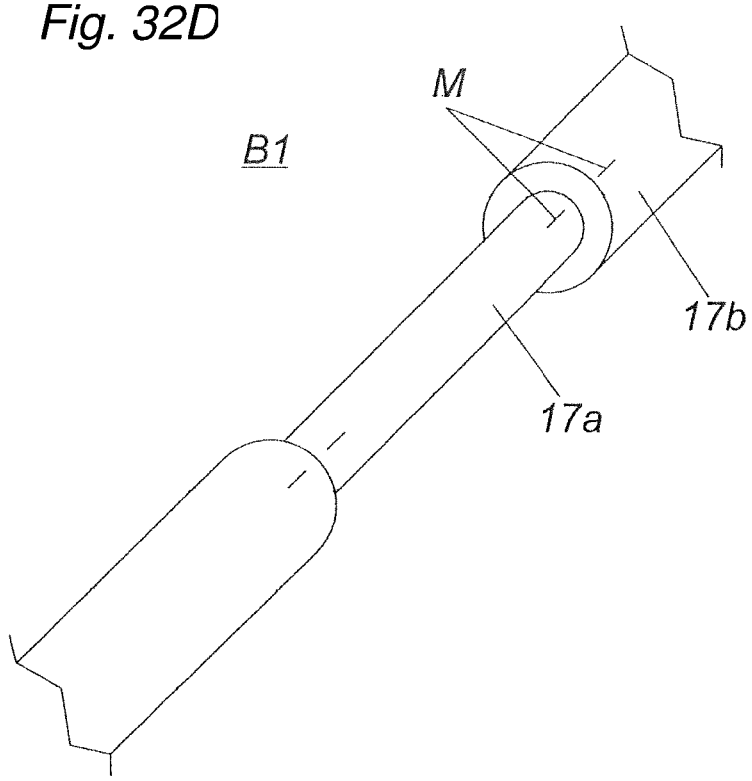
Figure 33D:
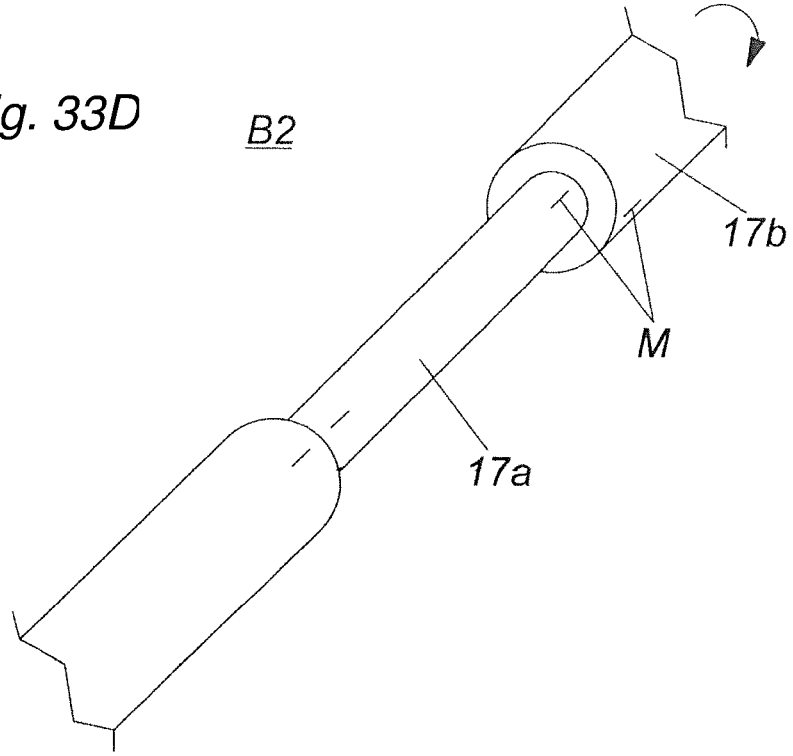

Also, in a comparison of the FIGS. 32D and 33D, the different operating positions B1 and B2 of the synchronizing device 6 are demonstrated. In particular, the inscribed markings M exemplify the relative rotary movement between the first rod member 17*a* and the second rod member 17*b*. The amount of the rotation is per se arbitrary as long as a false position is compensated thereby and also in the second operating position B2 approximately the same holding torque H is again given.

Figure 34C:
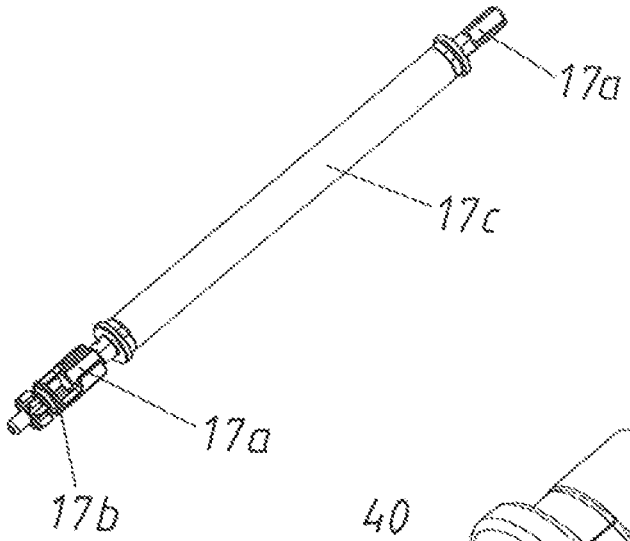
Figure 34A:
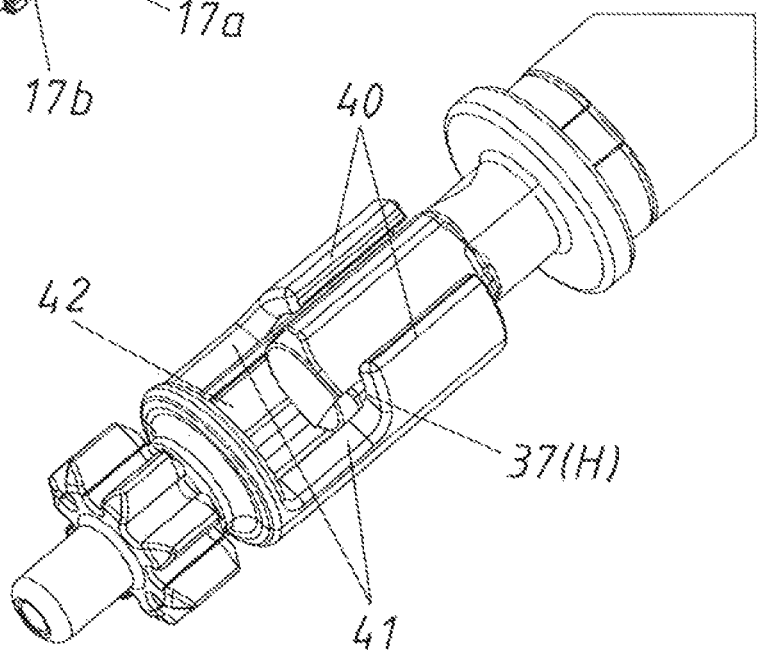
Figure 34B:
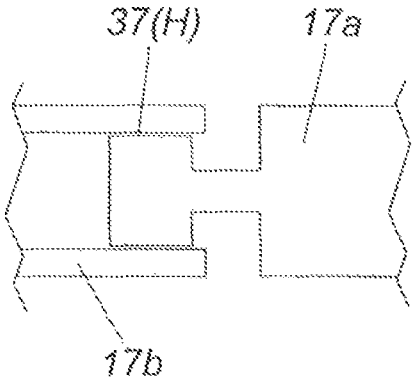
Figure 35B:
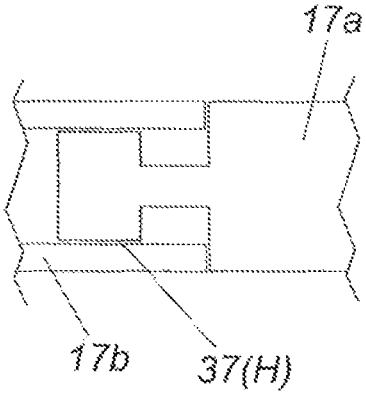
Figure 35C:
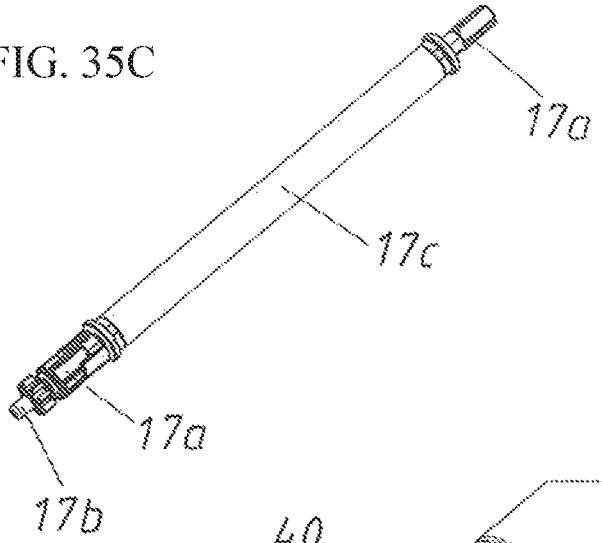
Figure 35A:
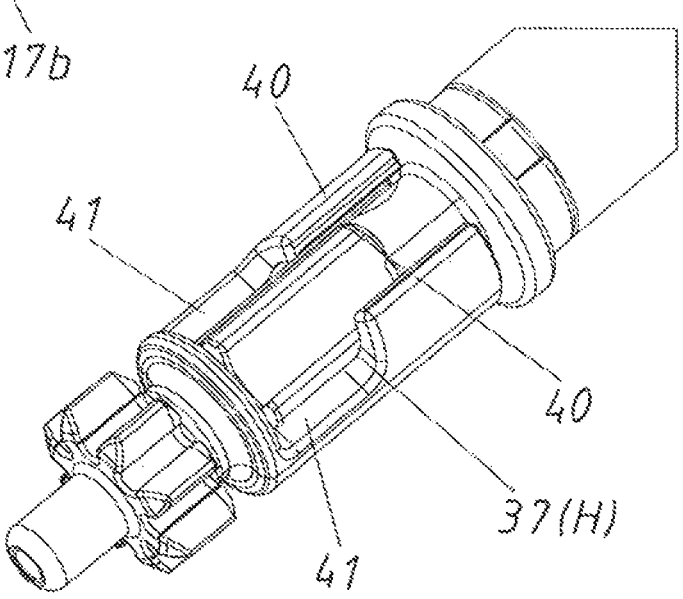

With reference to FIGS. 34C and 35C, it is initially noted that in the furniture industry plate thicknesses of 16 mm and 19 mm are the most common for wood and particle boards for the furniture construction. To be able to equip furniture items with these different plate thicknesses with structurally identical arrangements 1, mostly a length adaptation of the synchronizing rods 17 is carried out. However, to be able to guarantee the same functionality of the correction device 50 also in the case of differently long synchronizing rods 17, it is preferably provided that the holding torque H between the rod members 17*a* and 17*b*—independent of an insertion depth of the first rod member 17*a* in the second rod member 17*b*—remains substantially equal. Appropriately in FIGS. 34C and 34A a smaller insertion depth is illustrated (corresponding to a plate thickness of 16 mm). In this case the anterior part of the first rod member 17*a* is arranged in the bracket 40 in which the second rod member 17*b* is less rigid than in the area of the recesses 42. Thereby, the whole contact surface 37 between the rod members 17*a* and 17*b* is relatively large; however, a relative small rigidity of the brackets 40 is given. Thus, the elasticity and the size of the contact surfaces 37 cooperatively result in the holding torque H. In contrast, in the FIGS. 35C and 35B the first rod member 17*a* is inserted deeper into the second rod member 17*b* (corresponding for a plate thickness of 19 mm). In this case the size of the contact surfaces 37 is smaller because of the recesses 42. By the higher rigidity of the second rod member 17*b* in area near the gear wheel, in total, however, there is again the same holding torque H as in the case of a smaller insertion depth. In the case of different insertion depths and in the case of constant rigidity of the involved components a constant holding torque H can be guaranteed by the same size of the contact surfaces 37 alone. This is exemplified in a comparison between the FIGS. 34B and 35B.

With reference to the FIGS. 36 to 40 the motion sequence and the functional principle respectively of the arrangement 1 with a correction device 50 according to the invention are explained in the following.

Figure 36:
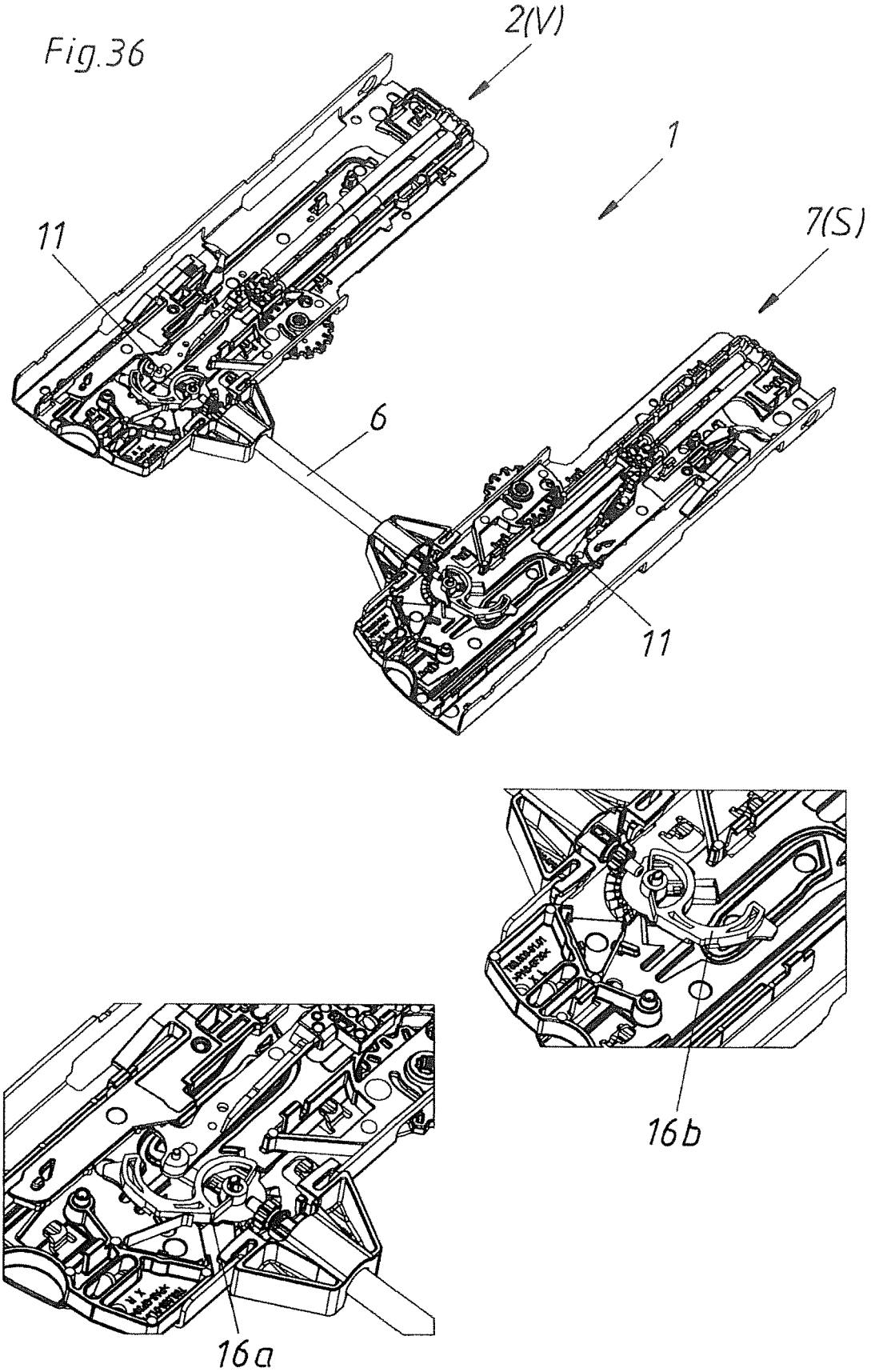
FIGS. 36 to 40 show the motion sequence of an arrangement corrected by the correction device.

In FIG. 36, the same initial position of the arrangement 1 as in FIG. 24 is given, only that in this case in an inverted manner the second drive device 7 is located in a position at the beginning of the tensioning section S, while the first drive device 2 is located in a position at the end of the locking section V.

If now pressing onto the opened furniture part 3 in closing direction SR starting from this position, so in the second drive device 7 the control lever 23 together with the latching element 11 moves—by the entrainment member 21 and the transmission element 20—along the tensioning section S. Thereby, the control lever 23 reaches contact with the second coupling element 16*b* as can be best seen in FIG. 37A bottom right. Already in this FIG. 37A it can be recognized that both drive devices 2 and 7 each comprise an elastic arm 44.

Figure 37A:
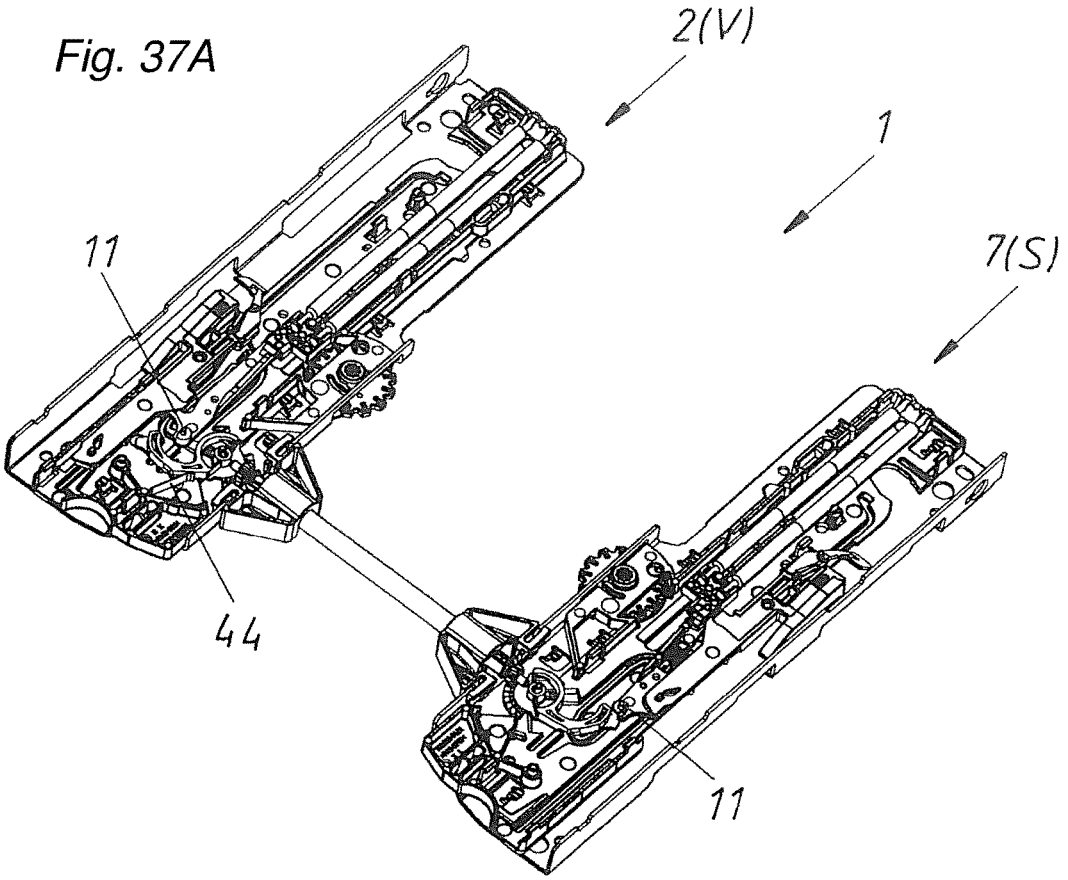
Figure 37A:
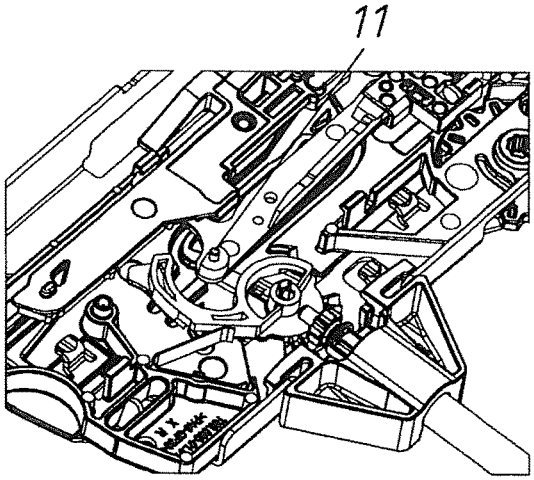
Figure 37A:
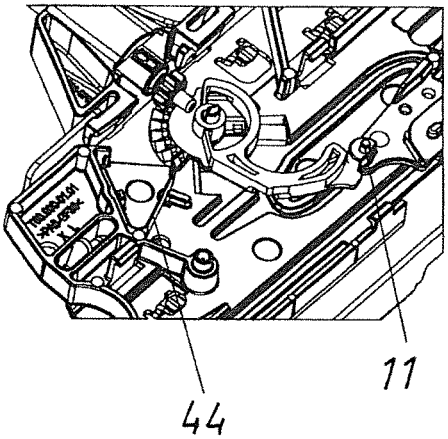
Figure 37B:
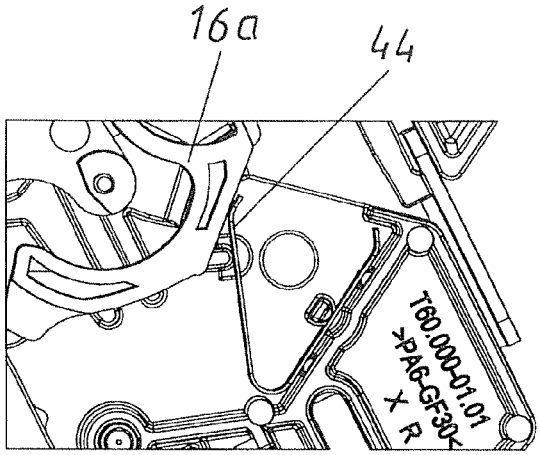
Figure 37B:
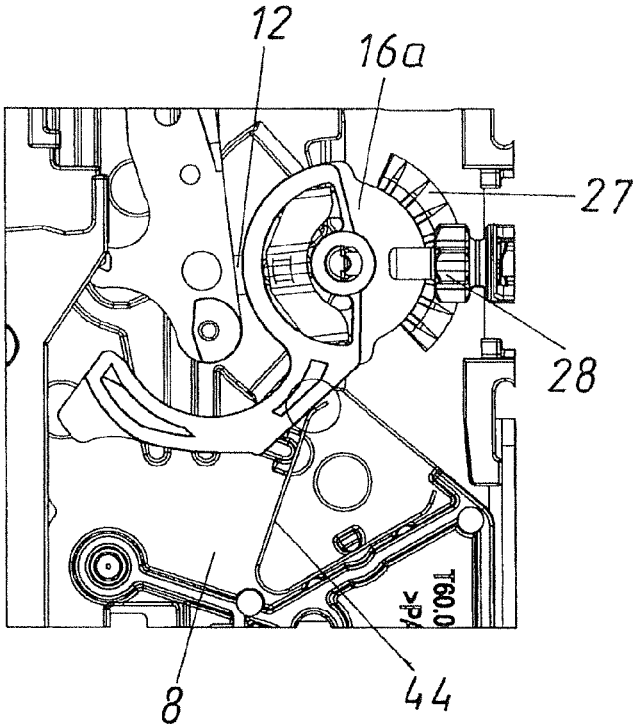
Figure 37B:
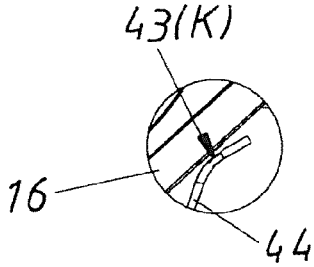

In detail, it follows from FIG. 37B that the plays of the individual components are adjusted to each other in such a way that a small gap remains between the coupling elements 16*a* and 16*b* and the limit-stop 43 formed by the elastic arm 44 when the locking element 12 is in the locking position. By its rigidity (spring rate) the elastic arm 44 by means of the limit-stop 43 opposes a certain force K to a corresponding movement of the respective coupling elements 16*a* and 16*b* respectively.

Figure 38:
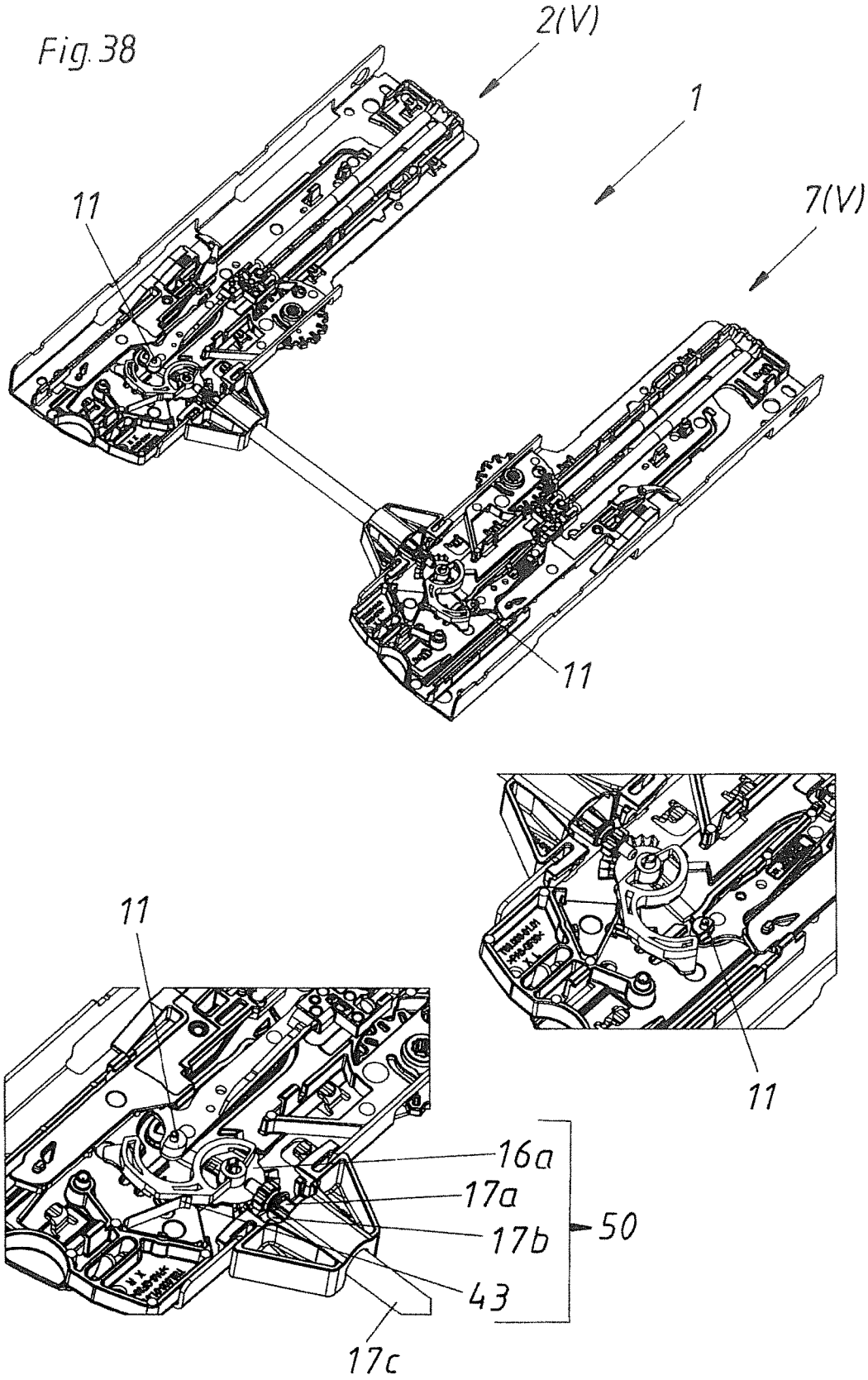

As soon as starting from the FIG. 37A the moveable furniture part 3 is further moved in closing direction SR, so the second coupling element 16*b* of the second drive device 7 starts to rotate clockwise (see FIG. 38). This movement is transmitted by means of the gear rack 27 and the gear wheel 28 to the synchronizing rod 17. As a result the first coupling element 16*a* moves counter-clockwise by means of the left-sided gear wheel 28 and the corresponding gear rack 27 until this first coupling element 16*a* bears against the limit-stop 43. In the case of a continued movement of the second coupling element 16*b* actuated by pressing, the correction device 50 is triggered in that a rotary movement between the first rod member 17*a* and the second rod member 17*b* is carried out as the force—in form of the holding torque H—between the two rod members 17*a* and 17*b* is smaller than the force K which the limit-stop 43 (or the elasticity of the elastic arm 44) opposes to a movement of the first coupling element 16*a*. In other words, the first coupling 16*a* is prevented from a further movement counter-clockwise by the limit-stop 43. As a result also the left-sided gear rack 27 is not moved further and the gear wheel 28 of the left-sided second rod member 17*b* is also no longer rotated. As the left-sided first rod member 17*a* however still receives a rotational momentum by the second coupling element 16*b*, the holding torque H between the two rod members 17*a* and 17*b* is overcome and the rod members 17*a* and 17*b* are rotating relative to each other from the first operating position B1 into the second operating position B2. In FIG. 38 the second drive device 7 has already reached the beginning of the locking section V, starting from where the contact between the control lever 23 and the second coupling element 16*b* has again ended. In FIG. 38 it is exemplified that the limit-stop 43, the first coupling element 16*a*, the first rod member 17*a*, and the second rod member 17*b* (together with the forces K and H acting in between) form the correction device 50. In the same manner also the structurally identical components on the other side form a correction device 50.

Figure 39:
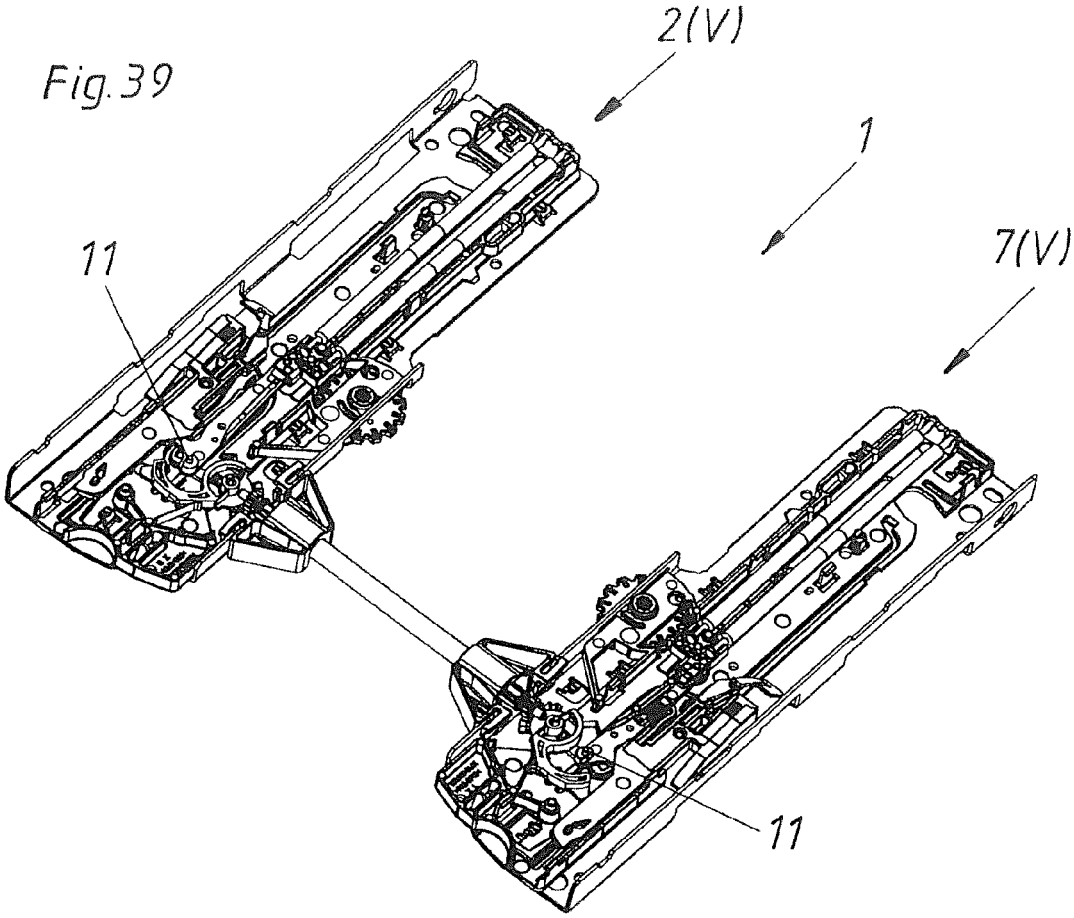
Figure 39:
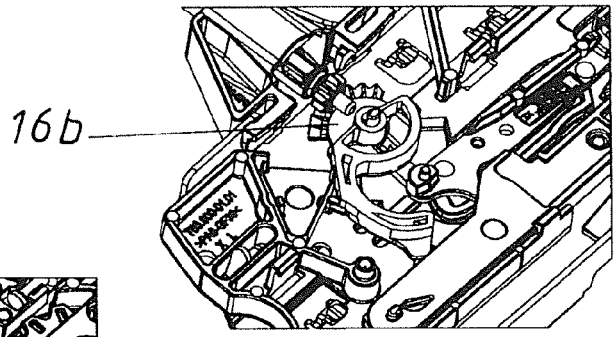
Figure 39:
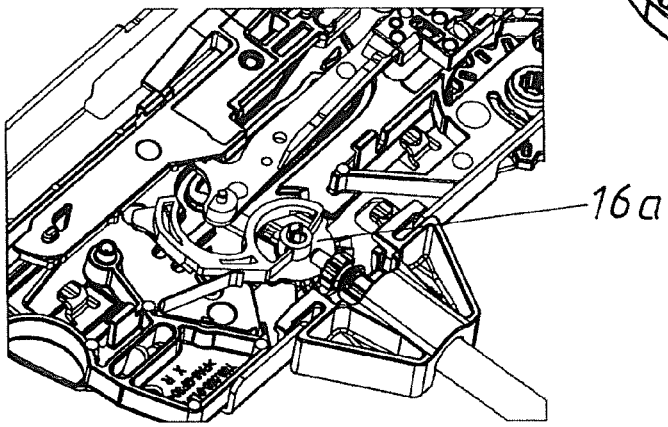

In FIG. 39 both drive devices 2 and 7 have finally reached the same position in which the respective latching element is located at the end of the locking section V.

Figure 40:
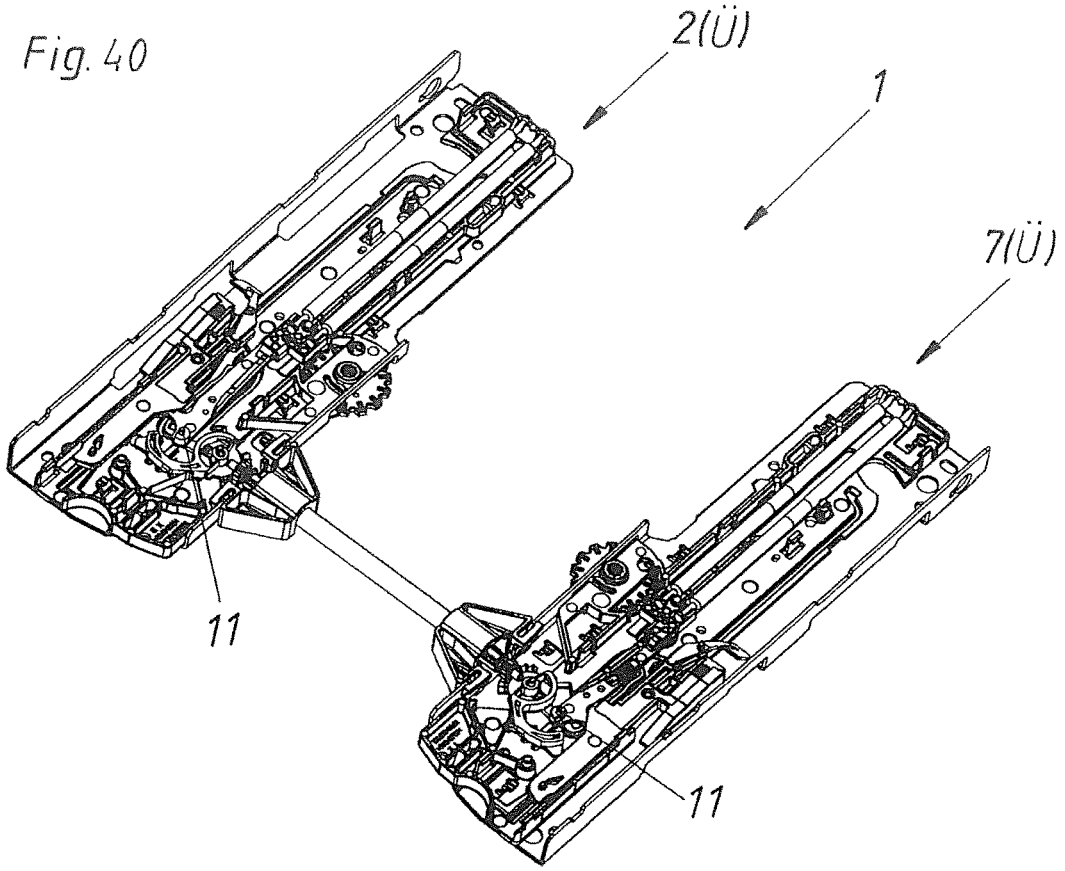
Figure 40:
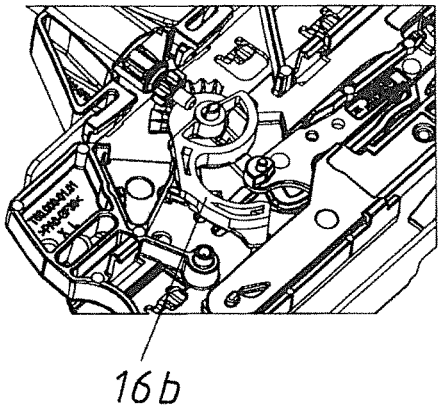
Figure 40:
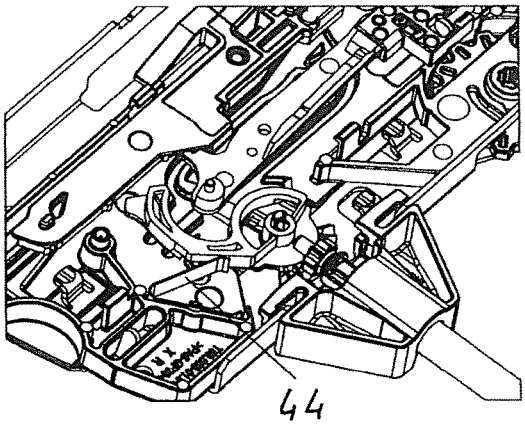

FIG. 40 shows yet a subsequent synchronized unlocking and over-pressing movement whereby in this case both latching elements 11 reach the over-pressing section Ü of the cardioidal sliding track 13.

Conclusively it is quoted that the limit-stop 43 can also be formed rigid. For example, the limit-stop 43 can be formed by a solid surface of the housing 8. The flexibility of the limit-stop 43, however, brings advantages in the case of a faulty operation. Once the drive device 2 or 7 is stopped shortly after the unlocking and at the beginning of the ejection section A, the latching element 11 can again reach the latching recess from the "wrong" side by turning the coupling element 16 against the force K of the elastic arm 44 by means of the latching element 11 coming from the ejection section A and bearing against the locking element 12.

It should also not be excluded that the elastic arm 44 is attached to the coupling element 16 and bears against a limit stop 43 which is then rigid and preferably formed by the housing 8. In this case, it is also important that the force K between the limit-stop 43 and the coupling element 16 is larger than the holding torque H.

The invention is described in this description particularly in respect of a rotating synchronizing rod 17. In an analogous manner, however, it is also quite possible that a correction device 50 is also used in the case of synchronizing devices 6 as they are described and shown in the embodiments (not according to the invention) according to the FIGS. 1 to 23B. It is also possible that the correction device 50 is integrated in the area of the drive device 2 and 7 instead of the area of the synchronizing device 6.

LIST OF REFERENCE SIGNS

1 arrangement
2 first drive device
3 moveable furniture part
4 first ejection device
5 first locking device
6 synchronizing device
7 second drive device
8 housing
9 ejection slider
10 ejection force storage member
11 latching element
12 locking element
13 cardioidal sliding track
14 locking surface
15 synchronizing surface
16 coupling element
16*a* first coupling element
16*b* second coupling element
17 synchronizing rod
17*a* first rod member
17*b* second rod member
17*c* third, profile-shaped rod member
18 item of furniture
19 furniture carcass
20 transmission element
21 entrainment member
22 catch lever
23 control lever
24 control track
25 transmission abutment
26 base plate
27 gear rack
28 gear wheel
29 return lever
30 elastic elements
31 holder
32 guide track
33 abutment
34 angled end section
35 inclined deflection section
36 extension guide
37 contact surface
38 mounting plate
39 clearance
40 brackets
41 recesses
42 convex parts
43 limit-stop
44 elastic arm
50 correction device
63 drawer bottom
drawer rail
SS closing position
OS open position
VS locking position
ÜS over-pressing position
OR opening direction
Ü over-pressing section
A ejection section
V locking section
DR pressing-through section
S tensioning section
D axis of rotation
M marking
B1 first operating position
B2 second operating position
H holding torque
K force

The invention claimed is:

1. An arrangement comprising:

a first drive device configured to move a moveable furniture part, the moveable furniture part not forming part of the arrangement, a second drive device configured to move the moveable furniture part, the two drive devices being configured to assume different positions during movement of the moveable furniture part, a synchronizing device for synchronizing the two drive devices, and a correction device for bringing the two drive devices into a same position, wherein the synchronizing device comprises a synchronizing rod with a first rod member and a second rod member rotatable relative to the first rod member, wherein the first and second rod members also form parts of the correction device, and wherein the first rod member is insertable into the second rod member, and a holding torque between the first and second rod members remains substantially constant independent of an insertion depth of the first rod member in the second rod member.

2. The arrangement according to claim 1, wherein the different positions of the first and second drive devices comprise a position in a tensioning section, a position in a locking section, a position in an over-pressing section, and a position in an ejecting section.

3. The arrangement according to claim 1, wherein the first and second drive devices can be brought into the same position by the correction device during the movement of the moveable furniture part.

4. The arrangement according to claim 1, wherein the correction device is part of the synchronizing device.

5. The arrangement according to claim 1, wherein the first and second rod members have a first operating position relative to each other, in which a predetermined holding torque is generated between the first and second rod members.

6. The arrangement according to claim 5, wherein the first and second rod members have a second operating position relative to each other, which second operating position is rotated in comparison to the first operating position, wherein in the second operating position the holding torque between the first and second rod members is substantially as large as the holding torque in the first operating position.

7. The arrangement according to claim 1, wherein the synchronizing device further comprises a first coupling element for connecting the synchronizing device with the first drive device, and a second coupling element for connecting the synchronizing device with the second drive device, wherein the first and second coupling elements are motion-transmitting connected by the synchronizing rod.

8. The arrangement according to claim 7, wherein the first and second coupling elements are moveable to a limited extent by a limit-stop.

9. The arrangement according to claim 8, wherein the limit-stop is formed yieldingly, wherein a rotary movement between the first rod member and the second rod member is carried out when the force between the first and second rod members is smaller than the force which the limit-stop opposes to a movement of one of the coupling elements, the force being a holding torque.

10. The arrangement according to claim 8, wherein the limit-stop is formed yieldingly on an elastic arm.

11. The arrangement according to claim 1, wherein the first and second drive devices each comprise a lockable ejection device for ejecting the moveable furniture part from a closed position into an open position and a locking device for locking the ejection device in a locking position, wherein the ejection device is unlockable from the locking position by an over-pressing movement of the moveable furniture part into an over-pressing position situated behind the closed position.

12. The arrangement according to claim 1, wherein the drive devices are substantially mirror-symmetrical to each other.

13. An item of furniture comprising:

a furniture carcass, a moveable furniture part being moveable on the furniture carcass, and the arrangement according to claim 1.

14. The item of furniture according to claim 13, wherein the first and second drive devices of the arrangement are arranged on opposite sides of the moveable furniture part.

15. The item of furniture according to claim 13, wherein the first and second drive devices are mounted to the moveable furniture part or to a drawer rail.

16. An arrangement comprising:

a first drive device configured to move a moveable furniture part, the moveable furniture part not forming part of the arrangement, a second drive device configured to move the moveable furniture part, the two drive devices being configured to assume different positions during movement of the moveable furniture part, a synchronizing device for synchronizing the two drive devices, and a correction device for bringing the two drive devices into a same position, wherein the synchronizing device comprises a synchronizing rod with a first rod member and a second rod member rotatable relative to the first rod member, and the synchronizing device further comprises a first coupling element for connecting the synchronizing device with the first drive device, and a second coupling element for connecting the synchronizing device with the second drive device, wherein the first and second coupling elements are motion-transmitting connected by the synchronizing rod, wherein the first and second coupling elements and the synchronizing rod each are motion-transmitting interconnected by a gear rack formed on each of the first and second coupling elements and by a gear wheel being part of the synchronizing rod.

17. An arrangement comprising:

a first drive device configured to move a moveable furniture part, the moveable furniture part not forming part of the arrangement, a second drive device configured to move the moveable furniture part, the two drive devices being configured to assume different positions during movement of the moveable furniture part, a synchronizing device for synchronizing the two drive devices, and a correction device for bringing the two drive devices into a same position, wherein the synchronizing device comprises a synchronizing rod with a first rod member and a second rod member rotatable relative to the first rod member, and the synchronizing device further comprises a first coupling element for connecting the synchronizing device with the first drive device, and a second coupling element for connecting the synchronizing device with the second drive device, wherein the first and second coupling elements are motion-transmitting connected by the synchronizing rod, wherein the first and second coupling elements are moveable to a limited extent by a limit-stop, and wherein, in the case of the first coupling element abutting the limit-stop and simultaneous movement of the second coupling element, the rod members of the synchronizing device prevent a movement transmission from the second coupling element to the first coupling element by rotation of the first and second rod members to each other.

18. An arrangement comprising:

a first drive device configured to move a moveable furniture part, the moveable furniture part not forming part of the arrangement, a second drive device configured to move the moveable furniture part, the two drive devices being configured to assume different positions during movement of the moveable furniture part, a synchronizing device for synchronizing the two drive devices, and a correction device for bringing the two drive devices into a same position, wherein the synchronizing device comprises a synchronizing rod with a first rod member and a second rod member rotatable relative to the first rod member, and the synchronizing device further comprises a first coupling element for connecting the synchronizing device with the first drive device, and a second coupling element for connecting the synchronizing device with the second drive device, wherein the first and second coupling elements are motion-transmitting connected by the synchronizing rod, wherein the first and second coupling elements are moveable to a limited extent by a limit-stop, and wherein the first and second coupling elements, the limit-stops for the first and second coupling elements, and the first and second rod members rotatable to each other collectively from the correction device.

* * * * *